US011340544B2

(12) United States Patent
Tajiri et al.

(10) Patent No.: US 11,340,544 B2
(45) Date of Patent: May 24, 2022

(54) IMAGE-FORMING APPARATUS PERFORMING CONVERTING PROCESS TO CONVERT PRINT DATA, IMAGE-FORMING PROCESS TO FORM DEVELOPER IMAGE ON SHEET USING CONVERTED DATA, AND FIXING PROCESS TO FIX DEVELOPER IMAGE TO SHEET

(71) Applicant: BROTHER KOGYO KABUSHIKI KAISHA, Nagoya (JP)

(72) Inventors: Fumitake Tajiri, Nagoya (JP); Yusuke Mizuno, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/125,425

(22) Filed: Dec. 17, 2020

(65) Prior Publication Data

US 2021/0191300 A1 Jun. 24, 2021

(30) Foreign Application Priority Data

Dec. 23, 2019 (JP) ..... JP2019-231474

(51) Int. Cl.
*G03G 15/20* (2006.01)
*G03G 21/18* (2006.01)

(52) U.S. Cl.
CPC ..... *G03G 15/2053* (2013.01); *G03G 15/205* (2013.01); *G03G 15/2039* (2013.01);
(Continued)

(58) Field of Classification Search
CPC ..... G03G 15/2053; G03G 15/2039; G03G 15/2064; G03G 2215/2038;
(Continued)

(56) References Cited

U.S. PATENT DOCUMENTS

2005/0220466 A1 10/2005 Takahashi et al.
2005/0262394 A1* 11/2005 Yasukawa ..... G06F 11/0733 714/23

(Continued)

FOREIGN PATENT DOCUMENTS

JP 2005-201917 A 7/2005
JP 2005-316397 A 11/2005

(Continued)

*Primary Examiner* — Walter L Lindsay, Jr.
*Assistant Examiner* — Laura Roth
(74) *Attorney, Agent, or Firm* — Merchant & Gould P.C.

(57) ABSTRACT

In an image-forming apparatus, a fixing device includes first and second fixing members; and a pressure modifying mechanism. The first and second fixing members form a nip. The pressure modifying mechanism modifies a nip pressure at the nip to one of a first nip pressure and a second nip pressure smaller than the first nip pressure. A controller performs: a converting process to convert print data into raster image data; an image-forming process to form a developer image on a sheet using the raster image data; and a fixing process to fix the developer image to the sheet with the fixing device at the first nip pressure. When a second converting process is not completed before a prescribed time following completion of a first fixing process has elapsed, the controller further performs a nip pressure reducing process to modify the nip pressure from the first to the second nip pressure.

15 Claims, 10 Drawing Sheets

(52) U.S. Cl.
CPC ..... *G03G 15/2064* (2013.01); *G03G 21/1857* (2013.01); *G03G 2215/2038* (2013.01)

(58) Field of Classification Search
CPC ..... G03G 15/5087; G03G 2221/1654; G03G 15/206; G03G 15/55; G03G 2215/2035; G03G 2221/1657; G03G 15/2032; G03G 15/2046; G03G 15/205; G03G 2215/2009; G03G 21/1857
See application file for complete search history.

(56) References Cited

U.S. PATENT DOCUMENTS

2011/0076056 A1* 3/2011 Sato ..... G03G 21/12 399/120
2012/0093531 A1* 4/2012 Yuasa ..... G03G 15/2032 399/67
2012/0251184 A1* 10/2012 Hashimoto ..... G03G 21/1647 399/223
2014/0016979 A1* 1/2014 Suzuki ..... G03G 15/6529 399/388
2014/0064763 A1* 3/2014 Watanabe ..... G03G 15/2064 399/67
2014/0160526 A1* 6/2014 Shinagawa ..... G03G 15/2046 358/1.15
2014/0348542 A1* 11/2014 Yoshida ..... G03G 15/2032 399/122
2015/0093152 A1* 4/2015 Hashimoto ..... G03G 15/0806 399/223
2015/0277261 A1* 10/2015 Suzuki ..... G03G 15/234 399/228
2015/0277279 A1* 10/2015 Suzuki ..... G03G 15/234 399/53
2015/0338807 A1 11/2015 Tanaka
2016/0223964 A1* 8/2016 Ikebuchi ..... G03G 15/2064
2017/0205743 A1* 7/2017 Kamiya ..... G03G 15/2064
2018/0046124 A1* 2/2018 Moriya ..... B65H 29/14
2019/0094768 A1 3/2019 Shinoya et al.
2020/0310281 A1* 10/2020 Haruta ..... G03G 21/1821

FOREIGN PATENT DOCUMENTS

JP 2015-219485 A 12/2015
JP 2016-177200 A 10/2016
JP 2019-066508 A 4/2019
JP 2019-113702 A 7/2019

* cited by examiner

IMAGE-FORMING APPARATUS PERFORMING CONVERTING PROCESS TO CONVERT PRINT DATA, IMAGE-FORMING PROCESS TO FORM DEVELOPER IMAGE ON SHEET USING CONVERTED DATA, AND FIXING PROCESS TO FIX DEVELOPER IMAGE TO SHEET

CROSS REFERENCE TO RELATED APPLICATION

This application claims priority from Japanese Patent Application No. 2019-231474 filed Dec. 23, 2019. The entire content of the priority application is incorporated herein by reference.

TECHNICAL FIELD

The present disclosure relates to an image-forming device having a fixing device to fix a developer image on a sheet.

BACKGROUND

A fixing device known in the art includes a heating body and a pressure roller. The heating body is provided with a belt formed in a loop, and a heater and a nip plate disposed inside the belt loop. The pressure roller presses the belt against the nip plate. The heating body can be switched between a pressure contact position in which the heating body contacts the pressure roller, and a separated position in which the heating body is separated from the pressure roller.

SUMMARY

The conventional image-forming device executes a development process on received print data in order to develop the print data into data that is usable by the image-forming device. If the development process for a prescribed sheet has not been completed while performing continuous printing on a plurality of sheets, a delay is generated. During this delay, the image-forming device cannot print on sheets until the development process for the prescribed sheet is completed. Some conventional devices may execute processes other than printing (a cleaning process or the like) during this time.

One non-printing process that an image-forming device with a fixing device having the above configuration can perform while waiting for the development process to be completed is a process for switching the heating body from the pressure contact position to the separated position. However, when a continuous print is resumed following completion of the development process, time is needed to switch the position of the heating body back from the separated position to the pressure contact position. This time may lengthen the overall time required to complete the continuous print.

In view of the foregoing, it is an object of the present disclosure to prevent the overall time from start to finish of a continuous print from becoming excessively long when a data development process causes a delay during the continuous print.

In order to attain the above and other objects, the present disclosure provides an image-forming apparatus including: an image-forming section; a fixing device; and a controller. The image-forming section is configured to form a developer image on a sheet. The fixing device is configured to fix the developer image on the sheet. The fixing device includes: a first fixing member; a second fixing member; and a pressure modifying mechanism. The first fixing member has a roller. The second fixing member has a belt. The belt is configured to form a nip together with the first fixing member. The pressure modifying mechanism is configured to modify a nip pressure at the nip to one of a first nip pressure and a second nip pressure smaller than the first nip pressure. The controller is configured to perform: a first converting process; a first image-forming process; a first fixing process; a second converting process; a second image-forming process; and a second fixing process. The first converting process converts print data into first raster image data. The first image-forming process forms a first developer image on a first sheet using the first raster image data with the image-forming section. The first fixing process fixes the first developer image to the first sheet with the fixing device at the first nip pressure. The second converting process converts the print data to second raster image data. The second image-forming process forms a second developer image on a second sheet using the second raster image data with the image-forming section. The second sheet is conveyed to the image-forming section following the first sheet. The second fixing process fixes the second developer image to the second sheet with the fixing device at the first nip pressure. When the second converting process is not completed before a first prescribed time following completion of the first fixing process has elapsed, the controller further performs a nip pressure reducing process. The nip pressure reducing process modifies the nip pressure from the first nip pressure to the second nip pressure.

According to another aspect, the present disclosure also provides an image-forming apparatus including: an image-forming section; a fixing device; and a controller. The image-forming section is configured to form a developer image on a sheet. The fixing device is configured to fix the developer image on the sheet. The fixing device includes: a first fixing member; a second fixing member; and a pressure modifying mechanism. The first fixing member has a roller. The second fixing member has a belt. The belt is configured to form a nip together with the first fixing member. The pressure modifying mechanism is configured to modify a nip pressure at the nip to one of a first nip pressure and a second nip pressure smaller than the first nip pressure. The controller is configured to perform: a first converting process; a first image-forming process; a first fixing process; a second converting process; a second image-forming process; and a second fixing process. The first converting process converts print data into first raster image data. The first image-forming process forms a first developer image on a first sheet using the first raster image data with the image-forming section. The first fixing process fixes the first developer image to the first sheet with the fixing device at the first nip pressure. The second converting process converts the print data to second raster image data. The second image-forming process forms a second developer image on a second sheet using the second raster image data with the image-forming section. The second sheet is conveyed to the image-forming section following the first sheet. The second fixing process fixes the second developer image to the second sheet with the fixing device at the first nip pressure. When the second image-forming process is not started before a first prescribed time following completion of the first fixing process has elapsed, the controller further performs a nip pressure reducing process. The nip pressure reducing process modifies the nip pressure from the first nip pressure to the second nip pressure.

BRIEF DESCRIPTION OF THE DRAWINGS

The particular features and advantages of the disclosure as well as other objects will become apparent from the following description taken in connection with the accompanying drawings, in which:

FIG. 9A illustrates an example in which the second converting process is completed during the first printing process and before a first sheet sensor is turned off;

FIG. 9B illustrates an example in which the second converting process is completed during the first printing process and after the first sheet sensor is turned off;

FIG. 9C illustrates an example in which the second converting process is not completed during the first printing process;

FIG. 10A illustrates an example in which the second converting process is completed during execution of a cleaning process; FIG. 10B illustrates an example in which the second converting process is not completed during the execution of the cleaning process.

DETAILED DESCRIPTION

Figure 1:
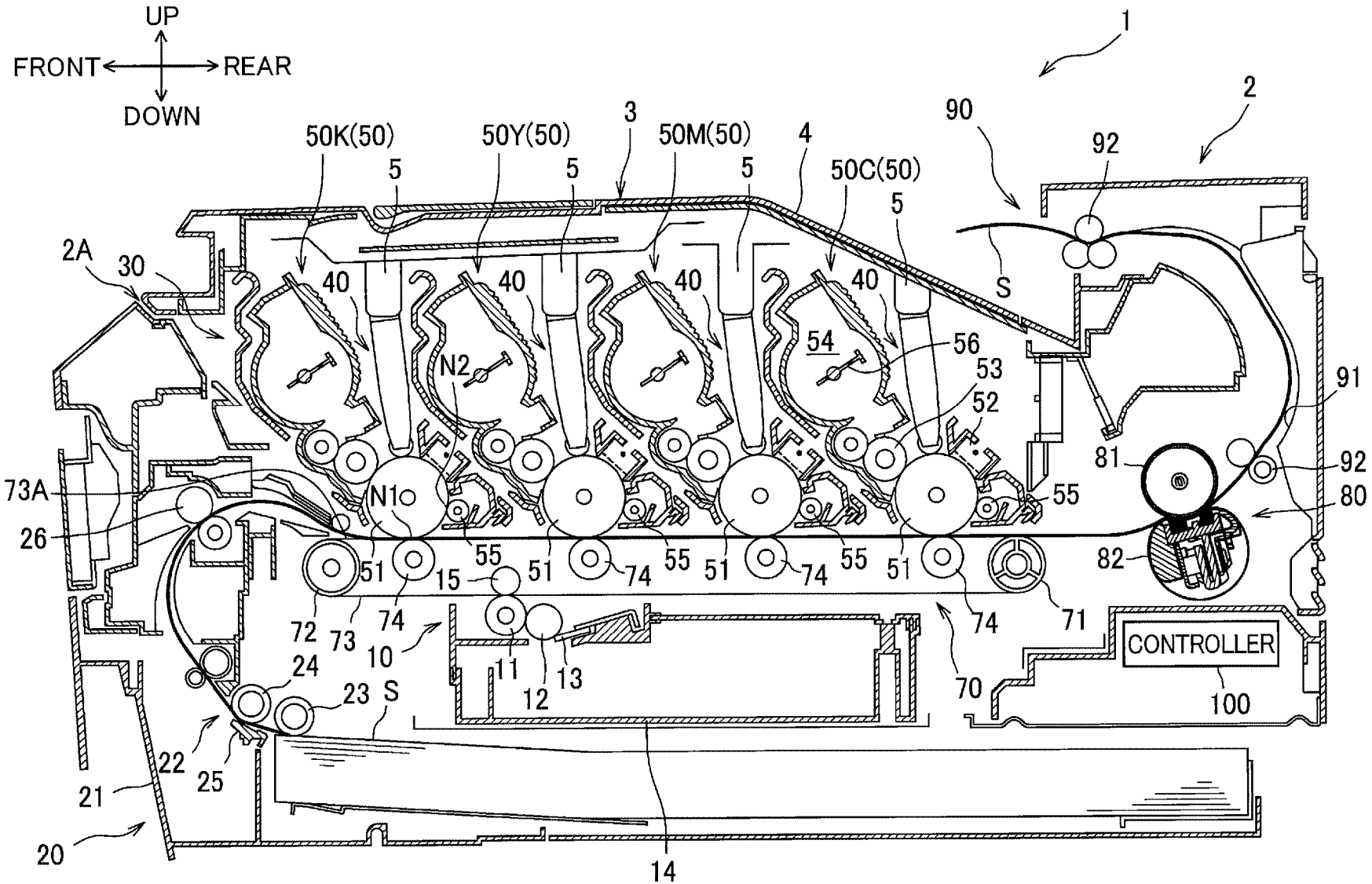
FIG. 1 is a cross-sectional view of a color printer according to an embodiment of the present disclosure.

Next, an embodiment of the present disclosure will be described while referring to the accompanying drawings. FIG. 1 shows a color printer 1 as an example of the image forming device. The color printer 1 is provided with a main casing 2 and, within the main casing 2, a sheet-feeding section 20 for supplying sheets S to be printed, an image-forming section 30 for forming toner images on the sheets S supplied by the sheet-feeding section 20, a fixing device 80 for fixing toner images on the sheets S, a paper-discharging section 90 for discharging sheets S from the main casing 2 after images have been formed on and fixed to the sheets S, and a controller 100.

An opening 2A is formed in the top of the main casing 2. An upper cover 3 is pivotally movably supported on the main casing 2, and opens and closes the opening 2A. The top surface of the upper cover 3 constitutes a paper discharge tray 4 that collects sheets S discharged from the main casing 2. A plurality of LED-mounting members 5 is provided on the bottom surface of the upper cover 3. Each LED-mounting member 5 retains an LED unit 40.

The sheet-feeding section 20 is disposed in the bottom section of the main casing 2. The sheet-feeding section 20 is provided with a sheet tray 21 that is detachably mounted in the main casing 2, and a sheet-feeding mechanism 22 that conveys sheets S from the sheet tray 21 toward the image-forming section 30. The sheet-feeding mechanism 22 includes a pickup roller 23, a separating roller 24, a separating pad 25, and registration rollers 26.

In the sheet-feeding section 20, the pickup roller 23 feeds sheets S from the sheet tray 21. Subsequently, the separating roller 24 and the separating pad 25 separate the sheets S fed by the pickup roller 23, ensuring one sheet is fed at a time. Thereafter, the registration rollers 26 straighten the leading edge of the sheet S before conveying the sheet S toward the image-forming section 30. Specifically, the registration rollers 26 are in a halted state when a sheet S is conveyed thereto. As the sheet S contacts the halted registration rollers 26, the leading edge of the sheet S becomes aligned with the registration rollers 26, thereby removing skew in the sheet S. Subsequently, the registration rollers 26 begins rotating to convey the sheet S onward.

The image-forming section 30 includes the four LED units 40, four process cartridges 50, a transfer unit 70, and a belt cleaner 10.

The LED units 40 are coupled to respective LED-mounting members 5 so as to be capable of pivoting relative to the LED-mounting members 5. Positioning members provided in the main casing 2 support the LED units 40 in appropriate positions.

The process cartridges 50 are juxtaposed in the front-rear direction between the upper cover 3 and the sheet-feeding section 20. Each process cartridge 50 is configured of a photosensitive drum 51 as an example of the photosensitive member, a charger 52, a developing roller 53, a toner-accommodating chamber 54 that accommodates toner (an example of the developer), a cleaning roller 55 as an example of the cleaning member, and an agitator 56 as an example of the agitator.

The process cartridges 50 are represented by the symbols 50K, 50Y, 50M, and 50C to indicate the color of toner they accommodate. Thus, the process cartridge 50K accommodates black (K) toner, the process cartridge 50Y accommodates yellow (Y) toner, the process cartridge 50M accommodates magenta (M) toner, and the process cartridge 50C accommodates cyan (C) toner. The process cartridges 50K, 50Y, 50M, and 50C are arranged in the order given beginning from the upstream side in the conveying direction of the sheets S. Note that the same symbols K, Y, M, and C are also appended to the photosensitive drums 51, the developing rollers 53, and the cleaning rollers 55 in the specification and the drawings to identify the colors of toner (i.e., black, yellow, magenta, and cyan) used with the corresponding members.

The photosensitive drums 51 are members capable of carrying toner. Specifically, each LED unit 40 exposes a surface of a corresponding photosensitive drum 51 so as to form an electrostatic latent image thereon, and an area of the photosensitive drum 51, on which the electrostatic latent image is formed, carries tonner. One photosensitive drum 51 is provided in each of the process cartridges 50. The photosensitive drums 51 are arranged at intervals along the conveying direction of the sheet S.

The developing rollers 53 are rollers that carry toner. The developing rollers 53 are configured to contact the corresponding photosensitive drums 51 in order to supply toner to the electrostatic latent images formed on the photosensitive drums 51.

The developing rollers 53 are capable of contacting or separating from the corresponding photosensitive drums 51. The controller 100 controls a switching mechanism SW described later (see FIG. 7) to switch the developing rollers 53 between a contact position and a separated position. Specifically, all developing rollers 53K, 53Y, 53M, and 53C are made to contact the corresponding photosensitive drums 51K, 51Y, 51M, and 51C in a color mode in order to supply toner to the corresponding photosensitive drums 51K, 51Y, 51M, and 51C. However, only the black developing roller 53K is placed in contact with the photosensitive drum 51K in a monochrome mode while the developing rollers 53Y, 53M, and 53C for the three remaining colors are separated from their corresponding photosensitive drums 51Y, 51M, and 51C. In a cleaning process described later, all developing rollers 53K, 53Y, 53M, and 53C are separated from the corresponding photosensitive drums 51K, 51Y, 51M, and 51C.

The cleaning rollers 55 are members capable of recovering toner from the corresponding photosensitive drums 51. One cleaning roller 55 is provided adjacent to the corresponding photosensitive drum 51.

The transfer unit 70 is disposed between the sheet-feeding section 20 and the process cartridges 50. The transfer unit 70 is provided with a drive roller 71, a follow roller 72, a transfer belt 73, and transfer rollers 74.

The drive roller 71 and the follow roller 72 are arranged parallel to each other while being separated in the front-rear direction. The transfer belt 73 is an endless belt that is stretched around the drive roller 71 and the follow roller 72. The transfer belt 73 is a member for conveying the sheets S. The outer surface of the transfer belt 73 contacts the photosensitive drums 51. Four of the transfer rollers 74 are disposed inside the transfer belt 73 at positions opposing corresponding photosensitive drums 51.

The transfer belt 73 is interposed between the photosensitive drums 51 and the corresponding transfer rollers 74. Sheets S are conveyed by the transfer belt 73 and the photosensitive drums 51.

The belt cleaner 10 is a device that slides against the transfer belt 73 in order to recover toner and other matter that has become deposited on the transfer belt 73. The belt cleaner 10 is disposed beneath the transfer belt 73. Specifically, the belt cleaner 10 is provided with a sliding-contact roller 11, a recovery roller 12, a blade 13, and a waste toner receptacle 14.

The sliding-contact roller 11 is disposed so as to contact the outer surface of the transfer belt 73. The transfer belt 73 is interposed between the sliding-contact roller 11 and a backup roller 15 provided inside the belt 73. The sliding-contact roller 11 recovers matter deposited on the transfer belt 73.

The recovery roller 12 is a roller that slides in contact with the sliding-contact roller 11 to recover matter deposited on the sliding-contact roller 11. The blade 13 is disposed so as to slide against the recovery roller 12 and scrapes off matter recovered on the recovery roller 12. Matter scraped off the recovery roller 12 falls into the waste toner receptacle 14.

The fixing device 80 is provided with a first fixing member 81 and a second fixing member 82. The structure of the fixing device 80 will be described later in greater detail.

With the image-forming section 30 having the structure described above, the charger 52 applies a uniform charge to the surface of the photosensitive drum 51. Subsequently, the charged surface of the photosensitive drum 51 is exposed by the LED unit 40, forming an electrostatic latent image on the photosensitive drum 51 based on image data. Thereafter, toner is supplied from the developing roller 53 to the electrostatic latent image to form a toner image that is carried on the photosensitive drum 51.

The toner image formed on each photosensitive drum 51 is transferred onto a sheet S carried on the transfer belt 73 as the sheet S passes between the photosensitive drum 51 and the corresponding transfer roller 74 disposed inside the transfer belt 73. The toner images transferred onto the sheet S are thermally fixed to the sheet S as the sheet S passes between the first fixing member 81 and the second fixing member 82.

The paper-discharging section 90 is provided with a discharge-side conveying path 91, and a plurality of conveying rollers 92. After toner images are thermally fixed to a sheet S, the conveying rollers 92 convey the sheet S along the discharge-side conveying path 91 and discharge the sheet S from the main casing 2 to be collected in the paper discharge tray 4.

Figure 2:
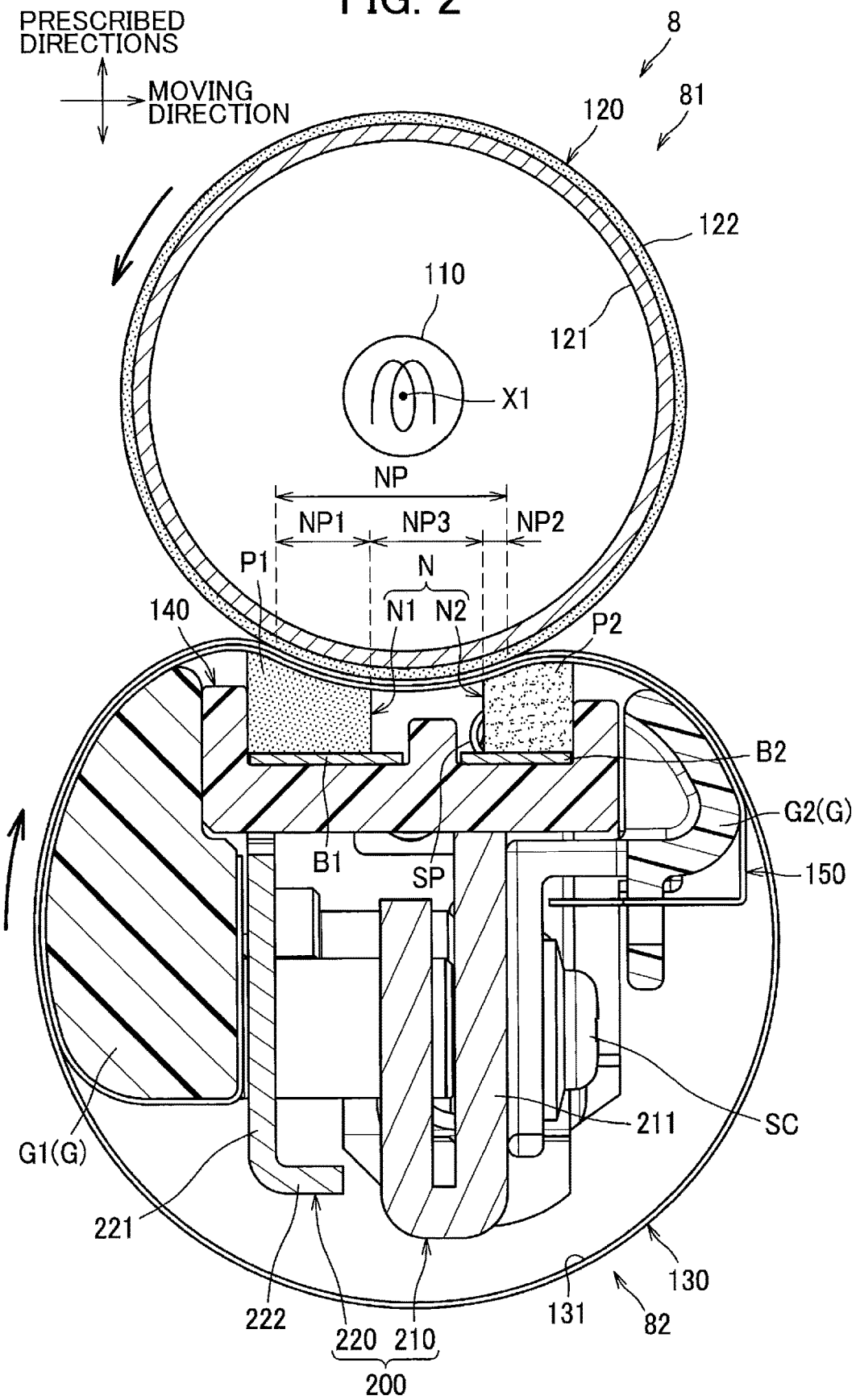
FIG. 2 is a cross-sectional view of a fixing device in the color printer according to the embodiment of the present disclosure.

As shown in FIG. 2, the fixing device 80 is provided with a heater 110, and a pressure-modifying mechanism 300 described later (see FIG. 4), in addition to the first fixing member 81 and the second fixing member 82 described above. The pressure-modifying mechanism 300 described later urges the second fixing member 82 against the first fixing member 81. In the following description, the direction in which the second fixing member 82 is urged against the first fixing member 81 and its opposite direction will be called the "prescribed directions." In the present embodiment, the prescribed directions are orthogonal to width directions and a moving direction described later and are the directions in which the first fixing member 81 and the second fixing member 82 oppose each other.

The first fixing member 81 has a rotatable roller 120. In a state where the second fixing member 82 is urged against the first fixing member 81, a nip area NP is formed therebetween. The second fixing member 82 is provided with a belt 130, a nip-forming member N, a holder 140, a stay 200, a belt guide G, and a sliding sheet 150. In the following description, the width directions of the belt 130 will simply be called "width directions." The width directions are the directions in which the rotational axis X1 of the roller 120 extends. Hence, the width directions are the same as the axial directions of the roller 120. The width directions are orthogonal to the prescribed directions.

The heater 110 is a halogen lamp. When powered, the heater 110 emits light and generates heat. The radiant heat generated by the heater 110 heats the roller 120. The heater 110 extends through the inside of the roller 120 along the rotational axis X1 of the same.

The roller 120 is a cylindrical roller elongated in the width direction. The roller 120 is heated by the heater 110. The roller 120 has a tubular body 121 formed of metal or the like, and an elastic layer 122 covering the outer surface of the tubular body 121. The elastic layer 122 is formed of a rubber, such as silicone rubber. The roller 120 is rotatably supported in side frames 83 described later (see FIG. 4). A fixing motor M2 (described later with reference to FIG. 7) provided in the main casing 2 inputs a drive force for driving the roller 120 to rotate counterclockwise in FIG. 2.

The belt 130 is a long cylindrical shaped member having flexibility. The belt 130 forms the nip area NP together with the first fixing member 81, and specifically the roller 120. While not shown in the drawings, the belt 130 has a base formed of a metal, resin, or the like, and a release layer covering the outer surface of the base. Owing to friction between the belt 130 and the roller 120 or a sheet S interposed between the belt 130 and the roller 120, the belt 130 rotates clockwise in FIG. 2 by following the roller 120 rotating. Grease or other lubricant is applied to an inner circumferential surface 131 of the belt 130. The nip-forming member N, the holder 140, the stay 200, the belt guide G, and the sliding sheet 150 are all disposed in the interior space defined by the cylindrical belt 130.

Hence, the nip-forming member N, the holder 140, the stay 200, the belt guide G, and the sliding sheet 150 are surrounded by the belt 130.

Figure 3:
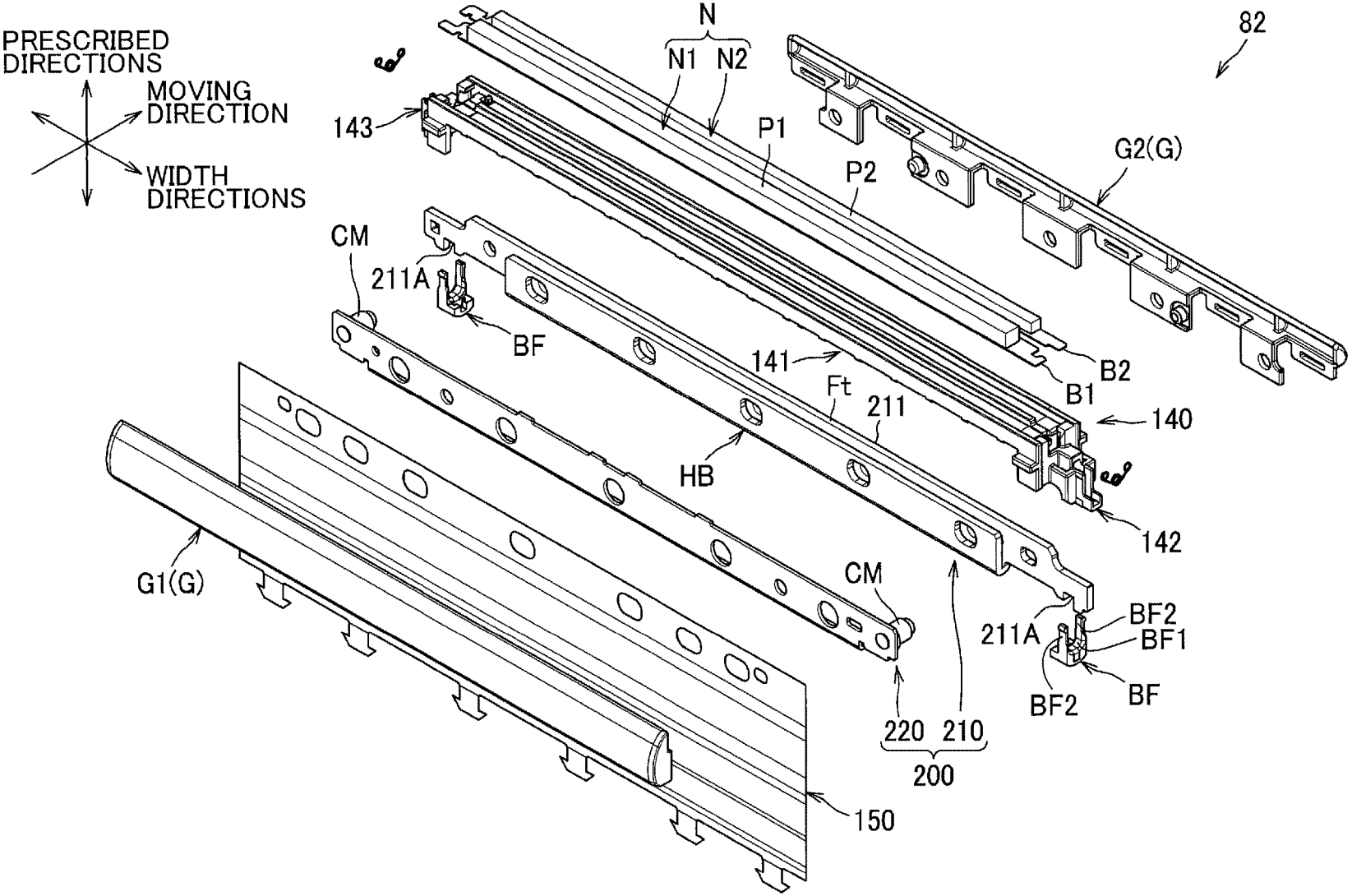
FIG. 3 is an exploded perspective diagram illustrating components disposed in the interior space defined by a belt in the fixing device.

As shown in FIGS. 2 and 3, the nip-forming member N together with the roller 120 nips a portion of belt 130 to form the nip area NP. The nip-forming member N includes an upstream nip-forming member N1 and a downstream nip-forming member N2.

The upstream nip-forming member N1 has an upstream pad P1, and an upstream fixing plate B1. The upstream pad P1 is a rectangular parallelepiped shaped member. The upstream pad P1 is formed of a rubber, such as silicone rubber. The upstream pad P1 together with the roller 120 nips a portion of the belt 130 to form an upstream nip area NP1.

In the following description, the direction in which the belt 130 moves in the upstream nip area NP1 and the nip area NP will simply be called the "moving direction." In the present embodiment, the moving direction is a direction that follows the outer circumferential surface of the roller 120. However, since this direction is substantially orthogonal to the prescribed directions and the width directions in the nip area NP, the moving direction is shown in the drawings to be a direction orthogonal to the prescribed directions and width directions. Note that the moving direction is identical to the conveying direction of the sheet S in the nip area NP.

The upstream pad P1 is fixed to the surface of the upstream fixing plate B1 that opposes the roller 120. The upstream fixing plate B1 is a member formed of a metal or other material that is harder than the upstream pad P1.

The downstream nip-forming member N2 is arranged on the downstream side of the upstream nip-forming member N1 in the moving direction and is spaced apart from the upstream nip-forming member N1. The downstream nip-forming member N2 has a downstream pad P2, and a downstream fixing plate B2.

The downstream pad P2 is a rectangular parallelepiped shaped member. The downstream pad P2 is formed of a rubber, such as silicone rubber. The downstream pad P2 together with the roller 120 nips a portion of the belt 130 to form a downstream nip area NP2. The downstream pad P2 is separated from the upstream pad P1 in the rotating direction of the belt 130.

Consequently, an intermediate nip area NP3 in which the second fixing member 82 applies no direct pressure to the first fixing member 81 exists between the upstream nip area NP1 and the downstream nip area NP2. Although the belt 130 contacts the roller 120 in this intermediate nip area NP3, the belt 130 applies almost no pressure to the roller 120 since there exists no member on the opposite side of the roller 120 with respect to the belt 130 in this area. Hence, a sheet S passing through the intermediate nip area NP3 is heated by the roller 120 but receives almost no pressure. In the present embodiment, the region from the upstream side of the upstream nip area NP1 to the downstream side of the downstream nip area NP2, i.e., the entire region on the outer surface of the belt 130 in contact with the roller 120 is called the nip area NP. Thus, the nip area NP in the present embodiment includes an area receiving no pressure from the upstream pad P1 and downstream pad P2.

In other words, the nip area NP is an area from an upstream end point where the belt 130 is in contact with the roller 120 in the moving direction to a downstream end point where the belt 130 is in contact with the roller 120 in the moving direction. The belt 130 and the roller 120 may be in contact with each other at a single point. In this case, the nip area is a single point of nip. Further, actions such as "nip", "pinch", and "grip" indicate that two components, such as the first fixing member 81 and the second fixing member 82, contact with each other with pressures generated therebetween. Thus, the nip area is an area or point in which two components contact with each other and which includes at least a nip where the two components are in contact with each other.

The downstream pad P2 is fixed to the surface of the downstream fixing plate B2 that opposes the roller 120. The downstream fixing plate B2 is a member formed of metal or the like that is harder than the downstream pad P2.

Note that the hardness of the upstream pad P1 is greater than the hardness of the elastic layer 122 provided on the roller 120. Further, the hardness of the downstream pad P2 is greater than the hardness of the upstream pad P1.

The term "hardness" in this specification denotes Shore hardness measured by a durometer according to the method specified in ISO 7619-1. Shore hardness is a value based on depth of indentation when a prescribed presser foot is pressed into a test piece under specified conditions. As an example, if the Shore hardness of the elastic layer 122 is 5 in the present embodiment, the Shore hardness of the upstream pad P1 is preferably between 6 and 10 while the Shore hardness of the downstream pad P2 is preferably between 70 and 90.

The holder 140 is a member that holds the nip-forming member N. The holder 140 is formed of a heat-resistant resin or the like. The holder 140 has a holder body 141, and two engaging parts 142 and 143 (see FIG. 3).

The holder body 141 is the member that holds the nip-forming member N. The majority of the holder body 141 is disposed within the range of the belt 130 in the width direction. The holder body 141 is supported by the stay 200.

The engaging parts 142 and 143 extend outward in the width directions from respective ends of the holder body 141. The engaging parts 142 and 143 are positioned outside the range of the belt 130 in the width direction. The engaging parts 142 and 143 engage with respective widthwise ends of a first stay 210 described later.

The stay 200 is a member that supports the holder 140. The stay 200 is positioned on the opposite side of the nip-forming member N with respect to the holder 140. The stay 200 is provided with the first stay 210, and a second stay 220. The second stay 220 is coupled to the first stay 210 by coupling members CM (see FIG. 3).

The first stay 210 is the member that supports the holder body 141 of the holder 140. The first stay 210 is formed of metal or the like. The first stay 210 has a base part 211, and a hemmed edge HB that has been bent in a hemming process.

The base part 211 has a contact surface Ft along the edge facing the holder 140 for contacting the holder body 141 of the holder 140. The contact surface Ft is a flat surface that is perpendicular to the prescribed directions.

The base part 211 has a load input part 211A disposed on each widthwise end. The load input parts 211A receive force from the pressure-modifying mechanism 300 described later (see FIG. 4). The load input parts 211A are formed in the edge of the base part 211 on the side opposite the nip-forming member N in the prescribed direction. The load input parts 211A are recessed parts opening toward the side opposite the nip-forming member N in the prescribed direction.

Buffer members BF are mounted in the respective load input parts 211A. The buffer members BF are formed of a resin or the like. The buffer members BF suppress rubbing between the metal base part 211 and metal arms 310 described later (see FIG. 4). Each buffer member BF has a fitting part BF1 that fits into the corresponding load input part 211A, and a pair of leg parts BF2 disposed respectively on the upstream side and downstream side of the outer widthwise end of the corresponding base part 211 in the moving direction.

The belt guide G is a member that guides the inner circumferential surface 131 of the belt 130. The belt guide G is formed of a heat-resistant resin or the like. The belt guide G has an upstream guide G1 and a downstream guide G2.

The sliding sheet 150 is a rectangular sheet provided to reduce frictional resistance between the belt 130 and the pads P1 and P2. The sliding sheet 150 is interposed between the inner circumferential surface 131 of the belt 130 and the pads P1 and P2 within the nip area NP. The sliding sheet 150 is formed of an elastically deformable material. While any suitable material may be used for the sliding sheet 150, a resin sheet containing polyimide is employed in the present embodiment.

As shown in FIG. 2, the upstream guide G1, the downstream guide G2, and the first stay 210 are jointly fastened by a screw SC.

Figure 4:
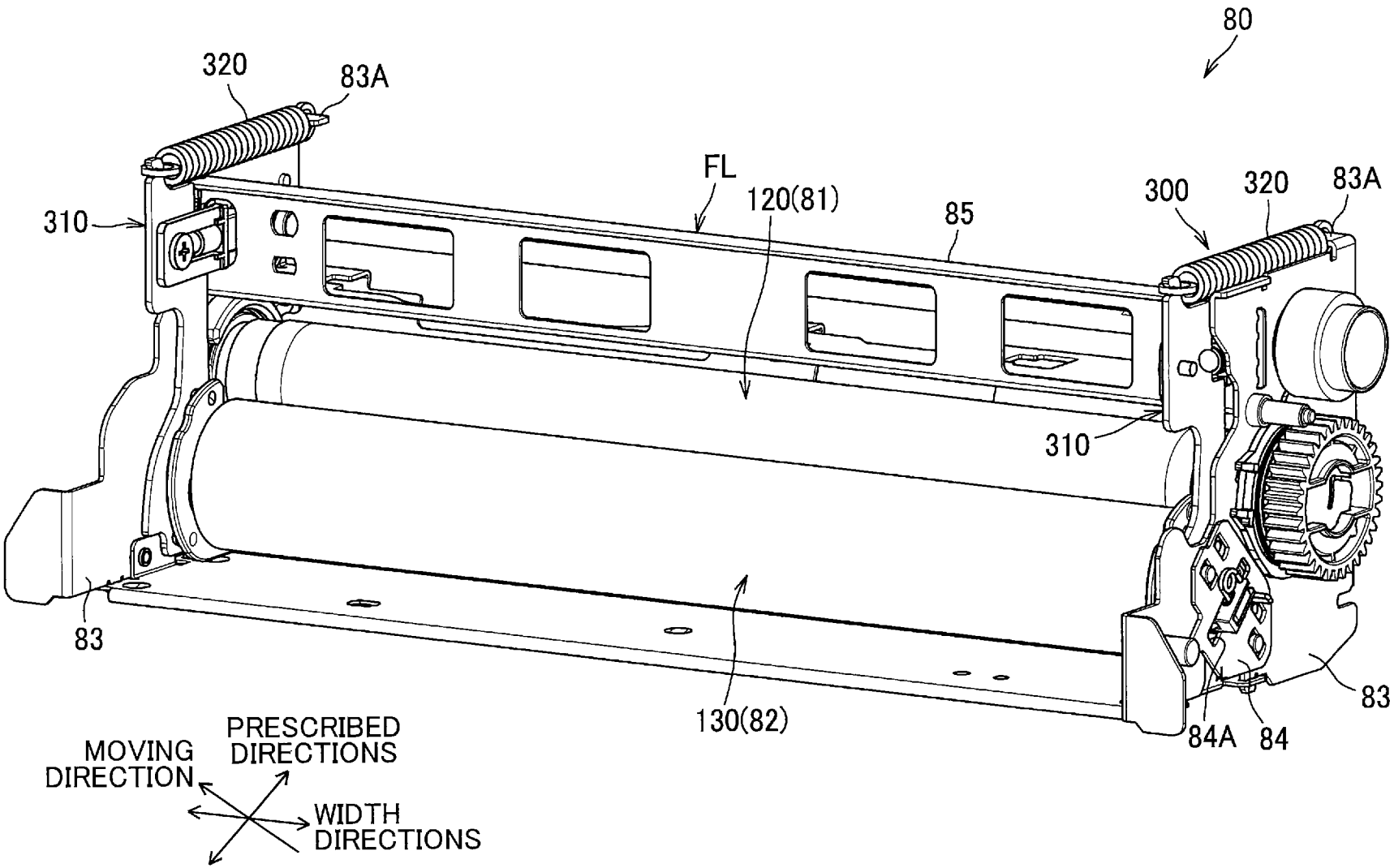
FIG. 4 is a perspective diagram illustrating a pressure-modifying mechanism of the color printer according to the embodiment of the present disclosure.

As shown in FIG. 4, the fixing device 80 is further provided with a frame FL, and a pressure-modifying mechanism 300. The frame FL is formed of metal or the like and supports the first fixing member 81 and the second fixing member 82. The frame FL includes two side frames 83, two brackets 84, and a connecting frame 85. The side frames 83 and the brackets 84 are disposed on widthwise ends of the first fixing member 81 and the second fixing member 82. The connecting frame 85 connects the two side frames 83.

The side frames 83 are frame members that support the first fixing member 81 and the second fixing member 82. Each side frame 83 has a spring-engaging part 83A. One end of a first spring 320 described later is engaged in each spring-engaging part 83A.

The brackets 84 are fixed to corresponding side frames 83. The brackets 84 are members that support the second fixing member 82 so that the second fixing member 82 can move in the prescribed directions. Specifically, each bracket 84 has a first elongate hole 84A elongated in the prescribed directions. The elongate holes 84A support corresponding ends of the first stay 210 via the engaging parts 142 and 143 of the holder 140 so that the first stay 210 can move in the prescribed directions.

Figure 5A:
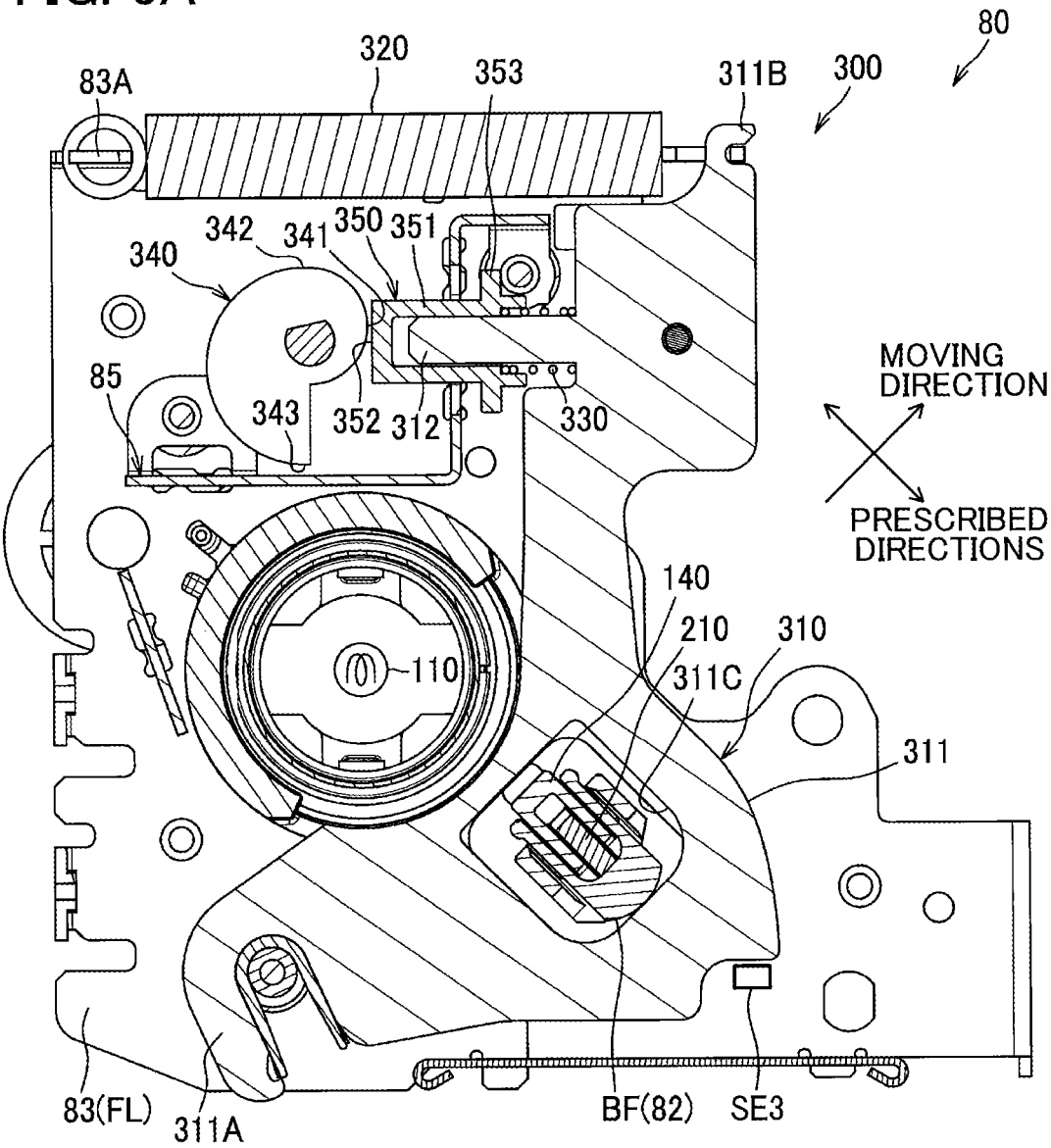
FIG. 5A is a cross-sectional view of the pressure-modifying mechanism when a cam of the pressure-modifying mechanism is at a first cam position, an arm body of the pressure-modifying mechanism is in a first orientation, and a nip pressure is the maximum nip pressure.

The pressure-modifying mechanism 300 modifies the nip pressure at the nip area NP. As shown in FIGS. 4 and 5A, the pressure-modifying mechanism 300 is provided with pairs of arms 310, first springs 320, second springs 330, and cams 340. One each of the arms 310, the first springs 320, the second springs 330, and the cams 340 is provided on a one widthwise side and another widthwise side of the frame FL.

The arms 310 are members for pressing the first stay 210 through the buffer members BF. The arms 310 support the second fixing member 82 and is pivotally movably supported by the side frames 83.

Each arm 310 has an arm body 311, and a cam follower 350. The arm bodies 311 are L-shaped plate members formed of metal or the like.

Each arm body 311 has a first end 311A pivotally movably supported on the corresponding side frame 83, a second end 311B coupled to an end of the corresponding first spring 320, and an engaging hole 311C that supports the second fixing member 82. The engaging hole 311C is formed in a position between the first end 311A and the second end 311B, and is engaged with the corresponding buffer member BF.

The arm body 311 also has a guide protrusion 312 that extends toward the cam 340. The guide protrusion 312 is disposed between the second end 311B and the engaging hole 311C in a direction from the second end 311B to the engaging hole 311C.

The cam follower 350 is mounted over the guide protrusion 312 of the arm body 311 and is capable of moving relative to the guide protrusion 312 and capable of contacting the cam 340. The cam follower 350 is formed of a resin or the like. The cam follower 350 has a cylindrical part 351 that is fitted over the guide protrusion 312, a contact part 352 provided on one end of the cylindrical part 351, and a flange part 353 provided on the other end of the cylindrical part 351.

The cylindrical part 351 is supported by the guide protrusion 312 and is capable of moving in the direction that the guide protrusion 312 extends. The contact part 352 is a wall closing the opening formed in the end of the cylindrical part 351 on the cam 340 side. The contact part 352 is arranged between the cam 340 and the end of the guide protrusion 312. The flange part 353 protrudes from the other end of the cylindrical part 351 in directions orthogonal to a direction in which the cam follower 350 moves.

The second spring 330 is disposed between the cylindrical part 351 and the arm body 311. With this configuration, the arm body 311 can be urged by the first spring 320 and by the second spring 330.

The first spring 320 applies a first urging force to the second fixing member 82, and specifically applies the first urging force to the second fixing member 82 through the arm body 311.

More specifically, the first springs 320 urge the upstream pad P1 and the downstream pad P2 toward the roller 120 through the arm bodies 311, the buffer members BF, the first stay 210, and the holder 140. The first springs 320 are tension coil springs formed of a metal or the like. One end of each first spring 320 is coupled with the spring-engaging part 83A of the corresponding side frame 83, while the other end is coupled with the second end 311B of the corresponding arm body 311.

The second spring 330 can apply a second urging force in the direction opposite the first urging force to the second fixing member 82, and specifically can apply the second urging force to the second fixing member 82 through the arm body 311. The second springs 330 are compression coil springs formed of a metal or the like. The second spring 330 is disposed between the corresponding cylindrical part 351 and the arm body 311 with the guide protrusion 312 inserted into the internal space formed in the compression coil spring 330.

The cam 340 is a member capable of changing the compressed state of the second spring 330 among a first compressed state in which the second urging force is not applied to the second fixing member 82, a second compressed state in which the second urging force is applied to the second fixing member 82, and a third compressed state in which the second spring 330 is further compressed from the second compressed state. The cam 340 is supported on the corresponding side frame 83 so as to be capable of pivotally moving (or rotating) among a first cam position shown in FIG. 5A, an intermediate cam position (not shown) pivotally moved (or rotated) approximately 90 degrees clockwise in FIG. 5A from the first cam position, and a second cam position pivotally moved (or rotated) approximately 270 degrees clockwise in FIG. 5A from the first cam position (see FIG. 6A).

The cams 340 are formed of a resin or the like. Each cam 340 has a first region 341, a second region 342, and a third region 343. The first region 341, the second region 342, and the third region 343 are positioned along the circumferential surface of the cam 340.

The first region 341 is the area on the cam 340 that is positioned closest to the cam follower 350 when the cam 340 is in the first cam position. When the cam 340 is in the first cam position shown in FIG. 5A, the first region 341 is separated from the cam follower 350.

The second region 342 is the area on the cam 340 that contacts the cam follower 350 when the cam 340 is in the intermediate cam position. More specifically, the second region 342 contacts the cam follower 350 when the cam 340 has been pivotally moved (or rotated) approximately 90 degrees clockwise in FIG. 5A from the first cam position. The distance from the second region 342 to the rotational center of the cam 340 is greater than the distance from the first region 341 to the rotational center of the cam 340.

Figure 6A:
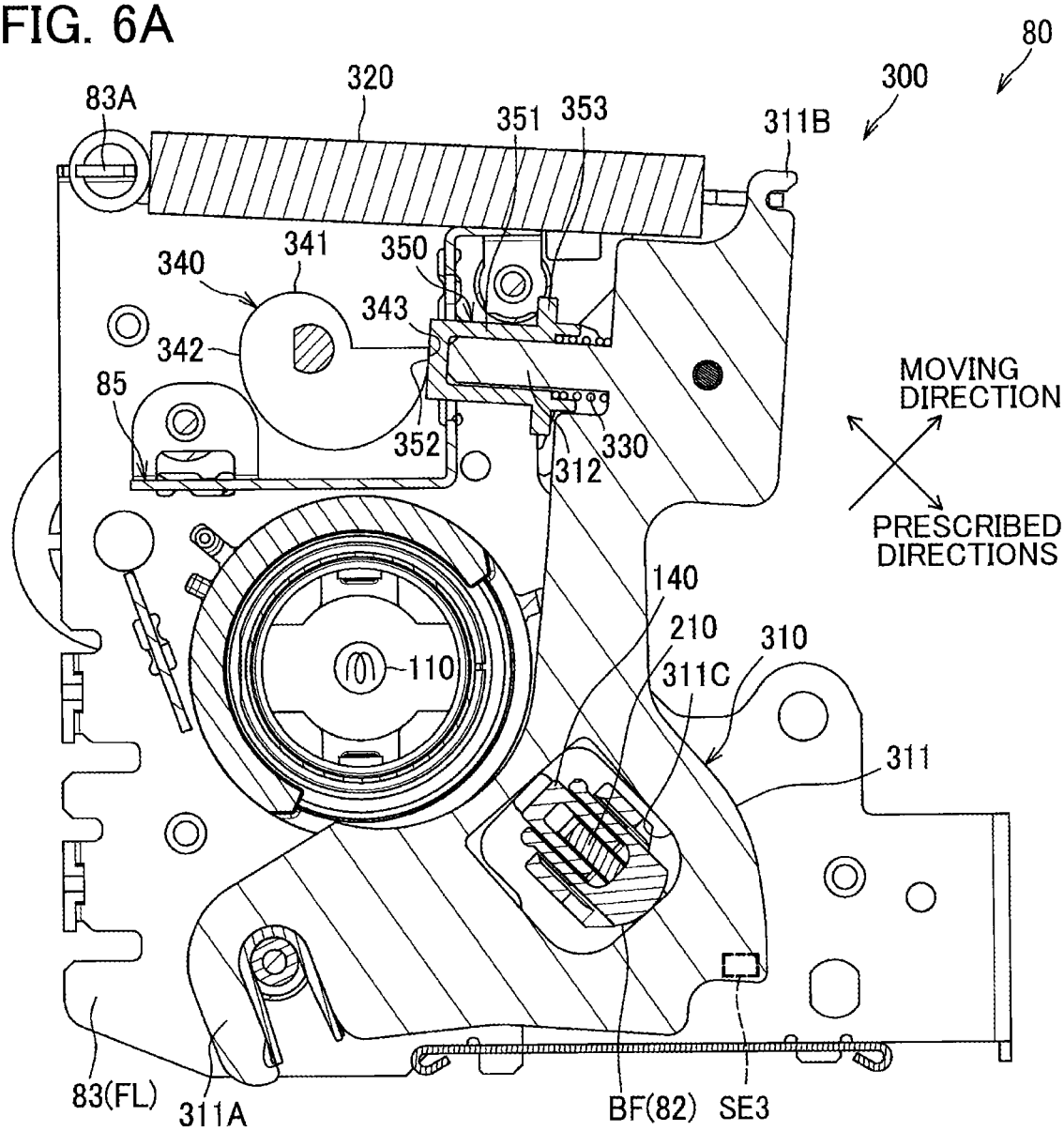
FIG. 6A is a cross-sectional view of the pressure-modifying mechanism when the cam is at a second cam position, the arm body is in a second orientation, and the nip pressure is the minimum nip pressure.

The third region 343 is the area on the cam 340 that contacts the cam follower 350 when the cam 340 is in the second cam position. More specifically, the third region 343 is the area of the cam 340 that contacts the cam follower 350 after the cam 340 has been pivotally moved (or rotated) clockwise in FIG. 5A approximately 270 degrees from the first cam position, as shown in FIG. 6A, or when the cam 340 has been pivotally moved (or rotated) clockwise in FIG. 5A approximately 180 degrees from the intermediate cam position. The distance from the third region 343 to the rotational center of the cam 340 is greater than the distance from the second region 342 to the rotational center of the cam 340.

When the cam 340 is in the first cam position, the second spring 330 is in the first compressed state owing to the cam 340 being separated from the cam follower 350. When the cam 340 has placed the second spring 330 in the first compressed state in this way, the arm body 311 is in a first orientation shown in FIG. 5A.

Specifically, when the cam 340 has placed the second spring 330 in the first compressed state, the cam 340 is separated from the cam follower 350 so that the second urging force of the second spring 330 is not applied to the second fixing member 82 via the arm body 311 and only the first urging force of the first spring 320 is being applied to the second fixing member 82 via the arm body 311. When the first spring 320 applies the first urging force to the second fixing member 82 while the second spring 330 does not apply the second urging force to the second fixing member 82 in this orientation, the nip pressure is a maximum nip pressure.

When the cam 340 is pivotally moved (or rotated) from the first cam position shown in FIG. 5A to the intermediate cam position, the cam 340 contacts the cam follower 350 and moves the cam follower 350 a prescribed amount relative to the arm body 311. In a state where the cam 340 is moved to the intermediate cam position, the compressed state of the second spring 330 is deformed to the second compressed state, a state more compressed than the first compressed state.

Since the cam follower 350 is pressed by the cam 340 when the cam 340 is in the intermediate cam position, the second urging force of the second spring 330 is applied to the second fixing member 82 via the arm body 311 in a direction opposite the first urging force. Accordingly, when the first spring 320 applies the first urging force to the second fixing member 82 and the second spring 330 applies the second urging force to the second fixing member 82, the nip pressure changes to an intermediate nip pressure that is smaller than the maximum nip pressure.

Note that when the cam 340 places the second spring 330 in the second compressed state, the arm body 311 remains in the first orientation described above. Here, the downstream pad P2 is still pressed against the roller 120 such that a load is being applied to the downstream pad P2. In a state where the downstream pad P2 is pressed against the roller 120, that is, in a state where the load is being applied to the downstream pad P2, the downstream pad P2 remains substantially unchanged in shape, regardless of the magnitude of the load. Since the downstream pad P2 is substantially unchanged in shape, the stay 200 supporting the downstream pad P2 and the arm 310 supporting the stay 200 remain in a substantially fixed position irrespective of the magnitude of the load. Further, since the position of the upstream pad P1 is determined by the position of the downstream pad P2, the position of the upstream pad P1 does not change while the downstream pad P2 remains substantially unchanged in shape and position. Accordingly, the total nip width (the length from the entrance of the upstream nip area NP1 to the exit of the downstream nip area NP2) is no different for a strong nip (maximum nip pressure) and a weak nip (intermediate nip pressure) and, hence, the position of the arm 310 is maintained substantially constant.

Here, the downstream pad P2 does not deform under these circumstances because the downstream pad P2 has a sufficiently greater hardness than the upstream pad P1 and the elastic layer 122 of the roller 120. More specifically, the downstream pad P2 has sufficient hardness to undergo almost no deformation at nip pressures required at the downstream nip area NP2 which are within a range from the maximum nip pressure (the downstream nip pressure in a strong nip) to the intermediate nip pressure (the downstream nip pressure in a weak nip).

In other words, the maximum nip pressure and the intermediate minimum nip pressure required for the downstream nip are set to magnitudes between which the downstream pad P2 undergoes almost no change in deformation.

Here, "the downstream pad P2 undergoes almost no change in deformation" allows for some deformation in the downstream pad P2, provided that the amount of change in the nip width of the downstream nip area NP2 formed by the downstream pad P2 (the nip length and position in the moving direction of the belt 130) does not affect sheet conveyance and image quality (i.e., the amount of change in the downstream nip width need not be zero).

In this way, since the arm body 311 is in the first orientation whether the compressed state of the second spring 330 is the first compressed state or the second compressed state, both the upstream pad P1 and the downstream pad P2 press the belt 130 against the roller 120 whether the nip position is the maximum nip pressure or the intermediate nip pressure. Specifically, since the position of the second fixing member 82 relative to the roller 120 is substantially the same for both the maximum and intermediate nip pressure states, the width of the nip area NP (length in the moving direction) is substantially the same for both states.

Here, the maximum nip pressure or the intermediate nip pressure is a first nip pressure that is set for printing, and specifically for fixing toner images to sheets S. For example, the maximum nip pressure is used when the sheet S has a first thickness, while the intermediate nip pressure is used when the sheet S has a second thickness greater than the first thickness. That is, the first nip pressure is set depending on thickness of the sheet S to one of the maximum nip pressure and the intermediate nip pressure.

Further, the first cam position or the intermediate cam position is a first position in which the nip pressure is the maximum nip pressure or the intermediate nip pressure (i.e., the first nip pressure). Further, the second cam position is a second position in which the nip pressure is the minimum nip pressure (i.e., a second nip pressure described later).

When pivotally moved (or rotated) from the intermediate cam position to the second cam position shown in FIG. 6A, the cam 340 first moves the cam follower 350 further toward the arm body 311 and subsequently presses the arm body 311 through the cam follower 350. Consequently, the second spring 330 is deformed to the third compressed state, which is more compressed than the second compressed state, and the arm body 311 is pivotally moved from the first orientation to a second orientation different from the first orientation.

Specifically, in the initial stage of the process for pivotally moving (or rotating) the cam 340 from the intermediate cam position to the second cam position, the cam follower 350 moves relative to the arm body 311 so that the contact part 352 of the cam follower 350 approaches the distal end of the guide protrusion 312. When the contact part 352 contacts the distal end of the guide protrusion 312, the compressed state of the second spring 330 is in the third compressed state. When the cam 340 has placed the second spring 330 in the third compressed state in this way, the contact part 352 constituting part of the cam follower 350 is interposed between the cam 340 and the guide protrusion 312. That is, the contact part 352 is in contact with both the cam 340 and the guide protrusion 312. Thereafter, as the cam 340 is pivotally moved (or rotated) further, the cam 340 presses the guide protrusion 312 through the contact part 352, causing the arm body 311 to pivotally move against the urging force of the first spring 320 from the first orientation to the second orientation.

Figure 5B:
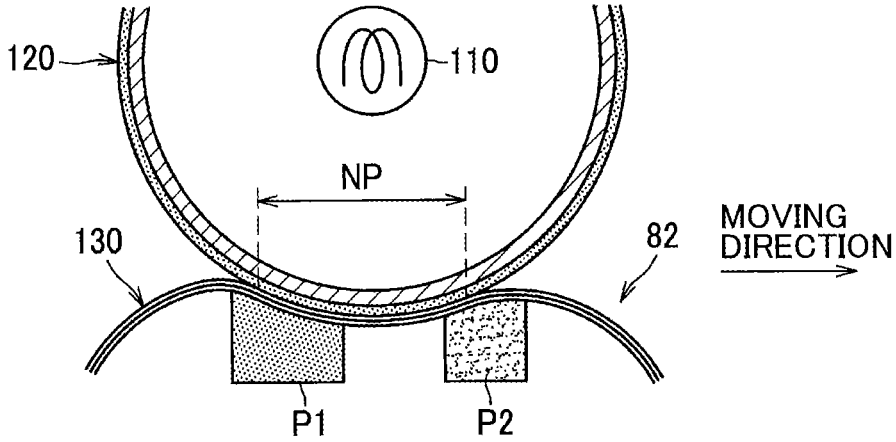
FIG. 5B is a cross-sectional view of the configuration around a nip area in the fixing device when the cam is at the first cam position, the arm body is in the first orientation, and the nip pressure is the maximum nip pressure.

When the arm body 311 is placed in the second orientation through this operation, the second fixing member 82 is positioned farther away from the roller 120 (the position in FIG. 6B) than when the arm body 311 is in the first orientation (the position in FIG. 5B). The position of the second fixing member 82 when the arm body 311 is in the first orientation will be called the "nip position" while the position of the second fixing member 82 when the arm body 311 is in the second orientation will be called the "nip reducing position." As the cam 340 pivotally moves (or rotates), the second fixing member 82 moves between the nip position and the nip reducing position in which the second fixing member 82 is farther away from the roller 120 than in the nip position.

Figure 6B:
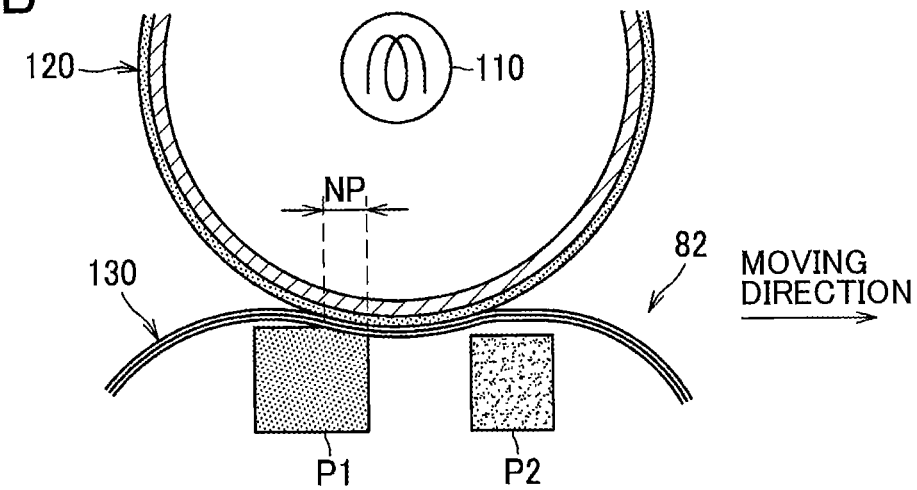
FIG. 6B is a cross-sectional view of the configuration around the nip area in the fixing device when the cam is at the second cam position, the arm body is in the second orientation, and the nip pressure is the minimum nip pressure.

When the second fixing member 82 is in the nip reducing position shown in FIG. 6B, the roller 120 is in contact with the belt 130 corresponding to a downstream portion of the upstream pad P1. Thus, in this case, the nip area NP is an area between the roller 120 and the belt 130 corresponding to the downstream portion of the upstream pad P1. In this case, though the roller 120 is in contact with the belt 130 in a region downstream of the upstream pad P1, almost no nip pressure is generated in this region. Accordingly, the nip area NP excludes the region downstream of the upstream pad P1. Although in this example the roller 120 is in contact with a part of the belt 130 in a region downstream of the upstream pad P1, the roller 120 may be separated from the part of the belt 130 in the region downstream of the upstream pad P1 when the second fixing member 82 is in the nip reducing position.

When the cam 340 is moved to the second cam position, causing the arm body 311 to switch to the second orientation, the position of the second fixing member 82 relative to the roller 120 changes such that the width of the nip area NP is smaller than when the arm body 311 is in the first orientation and that the nip pressure is the minimum nip pressure which is smaller than the intermediate nip pressure. In other words, by changing the orientation of the arm 310 with the cam 340, the nip pressure and the nip width are modified. Specifically, when the arm 310 is in the second orientation, the belt 130 is gripped only between the upstream pad P1 and the roller 120 and not between the downstream pad P2 and the roller 120. Consequently, when the arm 310 is in the second orientation, both the upstream nip pressure generated in the upstream nip area NP1 and the upstream nip width are reduced while the downstream nip pressure generated in the upstream nip area NP2 is eliminated. Put another way, when the arm 310 is in the second orientation, the upstream nip area NP1 is only a region where the nip pressure is generated whereas when the arm 310 is in the first orientation, both the upstream nip area NP1 and the downstream nip area NP2 are regions where the nip pressure is generated. Thus, the dimension of all the region (s) where the nip pressure is generated is smaller when the arm 310 is in the second orientation than when the arm is in the first orientation.

The minimum nip pressure is a second nip pressure set for non-printing times when printing is not being performed, and specifically when the fixing device 80 (a fixing motor M2 described later) is halted. The minimum nip pressure is also the smallest nip pressure in the range of nip pressures that can be modified by the pressure-modifying mechanism 300. The maximum nip pressure described above is the largest nip pressure within the same range.

In the present embodiment, the belt 130 is pinched between the upstream pad P1 and the roller 120 when the nip pressure is set to the second nip pressure, but the present disclosure is not limited to this configuration. For example, the belt 130 need not be pinched between the upstream pad P1 and the roller 120 when the nip pressure is the second nip pressure. In this case, the second nip pressure is zero.

Figure 7:
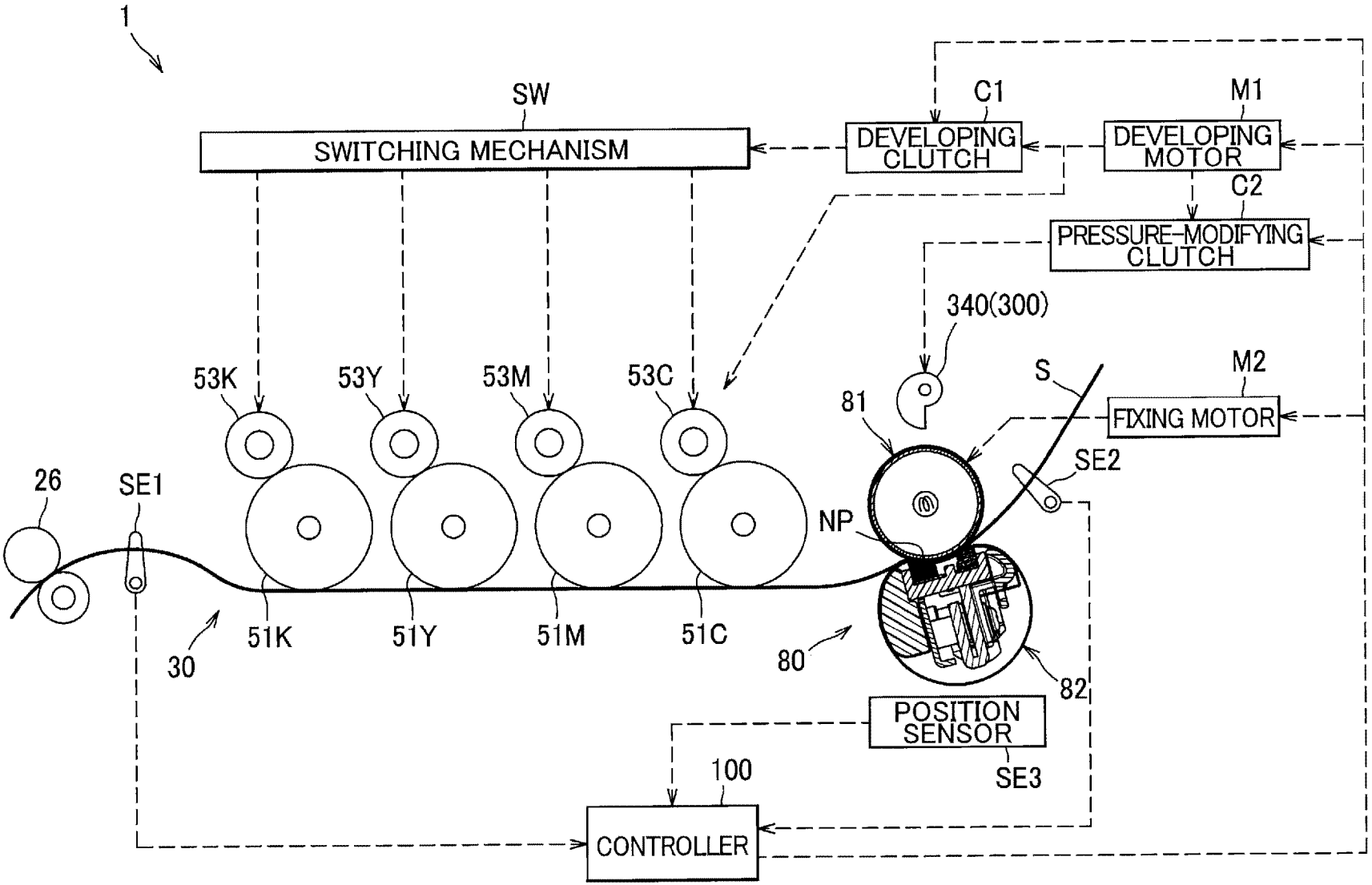
FIG. 7 is an explanatory diagram illustrating a relationship between a controller and components of the color printer according to the embodiment of the present disclosure, the components being controlled by the controller.

As shown in FIG. 7, the color printer 1 is also provided with a developing motor M1, a fixing motor M2, a developing clutch C1, a switching mechanism SW, a pressure-modifying clutch C2, a first sheet sensor SE1, a second sheet sensor SE2, and a position sensor SE3.

The developing motor M1 is configured to be rotatable in forward and reverse directions and is primarily provided for driving each developing roller 53 to rotate. In the present embodiment, the rotating direction of the developing motor M1 during printing will be called the forward direction. The developing motor M1 is coupled to the developing rollers 53 via gears and a clutch (not shown) to rotate the developing rollers 53. The developing motor M1 is also coupled to the switching mechanism SW via the developing clutch C1 and gears (not shown). The developing motor M1 is also coupled to the cam 340 of the pressure-modifying mechanism 300 via the pressure-modifying clutch C2 and gears (not shown). The developing motor M1 is an example of the motor of the present disclosure.

The fixing motor M2 is provided for driving the first fixing member 81 to rotate.

The developing clutch C1 is an electromagnetic clutch, for example. The developing clutch C1 can change between a first transmission state for transmitting the drive force of the developing motor M1 to the switching mechanism SW, and a first cutoff state for not transmitting the drive force of the developing motor M1 to the switching mechanism SW.

The switching mechanism SW is provided for switching the states of the developing rollers 53 between a contact state in which the developing rollers 53 are pressed against the photosensitive drums 51, and a separated state in which the developing rollers 53 are separated from the photosensitive drums 51. The switching mechanism SW switches the developing rollers 53 from the separated state to the contact state when the developing clutch C1 is set to the first transmission state under a condition that the developing rollers 53 are in the separated state and the developing motor M1 is rotating in the forward direction. The switching mechanism SW switches the developing rollers 53 from the contact state to the separated state when the developing clutch C1 is set to the first transmission state under a condition that the developing rollers 53 are in the contact state and the developing motor M1 is rotating in the forward direction.

The pressure-modifying clutch C2 is an electromagnetic clutch, for example. The pressure-modifying clutch C2 can change between a second transmission state for transmitting the drive force of the developing motor M1 to the cam 340 of the pressure-modifying mechanism 300, and a second cutoff state for not transmitting the drive force of the developing motor M1 to the cam 340. The cam 340 pivotally moves (or rotates) counterclockwise in the drawings from the second cam position shown in FIG. 6A to the first cam position shown in FIG. 5A when the pressure-modifying clutch C2 is placed in the second transmission state under a condition that the cam 340 is in the second cam position and the developing motor M1 is rotating in the forward direction. The cam 340 pivotally moves (or rotates) clockwise in the drawings from the first cam position shown in FIG. 5A toward the second cam position shown in FIG. 6A when the pressure-modifying clutch C2 is placed in the second transmission state under a condition that the cam 340 is in the first cam position and the developing motor M1 is rotating in the reverse direction.

The first sheet sensor SE1 and the second sheet sensor SE2 function to detect the presence or absence of a sheet S. Each of the sheet sensors SE1 and SE2 is provided with a pivoting lever that pivots when pressed by a sheet S conveyed in the conveying direction, and a photosensor that detects the pivoting of the pivot lever. In the present embodiment, the sheet sensors SE1 and SE2 are set to ON when a sheet S is passing, i.e., when the pivoting lever is being pushed over by a sheet S, and are set to OFF when a sheet S is not passing, i.e., when the pivoting lever is not being pushed over by a sheet S. However, the relationship between the orientation of the pivoting levers and the ON/OFF signals from the sheet sensors SE1 and SE2 may be reversed.

The expression "a sensor for detecting a prescribed event" in this specification signifies a sensor for outputting a signal that enables the controller 100 to determine whether a prescribed event has occurred. For example, the "sensor for detecting the presence or absence of a sheet S" described above denotes a sensor that outputs a signal by which the controller 100 can determine the presence or absence of a sheet S.

In the present embodiment, if the sheet sensor SE1 or SE2 is ON, the controller 100 determines that a sheet S is present at the position of the sheet sensor SE1 or SE2. If the sheet sensor SE1 or SE2 is OFF, the controller 100 determines that a sheet S is not present at the corresponding position of the sheet sensor SE1 or SE2.

The first sheet sensor SE1 is disposed upstream of the fixing device 80 in the conveying direction of the sheet S. Specifically, the first sheet sensor SE1 is disposed downstream of the registration rollers 26 and upstream of the image-forming section 30 in the conveying direction of the sheet S.

The second sheet sensor SE2 is provided for detecting the presence or absence of a sheet S in the fixing device 80. The second sheet sensor SE2 is disposed downstream of the nip area NP in the conveying direction of the sheet S.

The position sensor SE3 is provided for detecting the position of the second fixing member 82. Specifically, the position sensor SE3 is disposed near the nip reducing position and detects the second fixing member 82 when the second fixing member 82 nears the nip reducing position. FIG. 5A shows an example in which the position sensor SE3 is disposed in a position capable of detecting pivoting of the arm body 311. However, the position sensor SE3 may be disposed in any position capable of detecting a member that moves in association with movement of the second fixing member 82.

The position sensor SE3 may be configured of a photosensor having a light-emitting unit and a light-receiving unit, for example. When the second fixing member 82 is in the nip position (when the arm body 311 is in the first orientation) as shown in FIG. 5A, light emitted from the light-emitting unit is not blocked by the arm body 311 and is received by the light-receiving unit. When the second fixing member 82 is in the nip reducing position (when the arm body 311 is in the second orientation) as shown in FIG. 6A, light emitted from the light-emitting unit is blocked by the arm body 311 and, hence, not received by the light-receiving unit. The position sensor SE3 configured in this way can detect when the second fixing member 82 approaches the nip reducing position.

The controller 100 is provided with a CPU, a RAM, a ROM, a nonvolatile memory, ASICs, input/output circuits, and the like. The controller 100 executes various processes by performing computational operations based on print commands outputted from an external computer, signals outputted from the sensors SE1-SE3 and programs and data stored in a ROM and the like. The controller 100 is configured to perform a converting process, a printing process, a preliminary process, a nip pressure reducing process, a nip pressure increasing process, a determination process, a cleaning process, a developing roller separation process, and a developing roller contact process.

The converting process is performed to convert print data included in a print command into data used for forming toner images with the image-forming section 30, and specifically raster image data used for exposing the photosensitive drums 51. More specifically, the converting process is executed for each sheet S when printing a plurality of sheets S continuously. The controller 100 executes the converting process for print data to be printed on a prescribed sheet S prior to executing the printing process on the prescribed sheet S. After completing the converting process, the controller 100 executes the printing process on the prescribed sheet S. Further, after completing the converting process on print data for the prescribed sheet S, the controller 100 immediately begins a converting process on print data for the sheet S to be conveyed after the prescribed sheet S. The print data included in the print command is data such as page description language, bitmap image data, vector image data, and the like.

In the following description, the converting process performed for a first sheet SH1 (the first sheet S in a print job, for example) to convert print data corresponding to the first sheet SH1 into first raster image data to be used for forming a toner image with the image-forming section 30 will be called a "first converting process," and the converting process performed for a second sheet SH2 (the second sheet S in the print job, for example) to be conveyed after the first sheet SH1 in order to convert the print data corresponding to the second sheet SH2 into second raster image data to be used for forming a toner image with the image-forming section 30 will be called a "second converting process." Thus, when continuously printing on a plurality of sheets S, the controller 100 repeatedly executes the first converting process and the second converting process.

The printing process is executed to print on a sheet S. The printing process has an image-forming process and a fixing process. The fixing process is executed after the image-forming process in the printing process. Thus, the printing process begins at the start of the image-forming process and ends at the end of the fixing process.

In the image-forming process, the controller 100 controls the image-forming section 30 to form a toner image on a sheet S using raster image data. When printing continuously on a plurality of sheets S, the image-forming process is executed for each sheet S. In the image-forming process, each LED unit 40 exposes the corresponding photosensitive drum 51 in accordance with the timing that the prescribed sheet S arrives at each photosensitive drum 51, and the toner image formed on each photosensitive drum 51 is subsequently transferred onto the prescribed sheet S. The exposure process begins a prescribed time interval after the prescribed sheet S has been fed. The image-forming process begins when the exposure process begins and ends when the transfer of toner images onto the prescribed sheet S is completed. In the following description, the image-forming process for forming a toner image on the first sheet SH1 (the first sheet S in the print job, for example) will be called the "first image-forming process," and the image-forming process for forming a toner image on the second sheet SH2 (the second sheet S in the print job, for example) conveyed after the first sheet SH1 will be called the "second image-forming process."

In the fixing process, the fixing device 80 fixes the toner images, which were formed using the developed data, to the sheet S. Specifically, the fixing process includes a process for controlling the heater 110 so that the temperature at the nip area NP is maintained at a suitable temperature for fixing, a process for controlling the fixing motor M2 to rotate the first fixing member 81 at a prescribed speed, and a process for maintaining the nip pressure at the first nip pressure. The fixing process is executed for a prescribed sheet S at least while the prescribed sheet S is passing through the nip area NP. In the present embodiment, the fixing process for a prescribed sheet S begins when the leading edge of the prescribed sheet S arrives at the nip area NP and ends when the trailing edge of the prescribed sheet S passes the second sheet sensor SE2. Hence, the "end of the fixing process" signifies the timing at which the trailing edge of the prescribed sheet S passes the second sheet sensor SE2. In the following description, the fixing process performed on the first sheet SH1 (the first sheet S in the print job, for example) for fixing a toner image formed using the first data to the first sheet SH1 will be called the "first fixing process," and the fixing process performed on the second sheet SH2 (the second sheet S in the print job, for example) conveyed after the first sheet SH1 for fixing a toner image formed using the second data to the second sheet SH2 will be called the "second fixing process."

As described above, the printing process includes the image-forming process and the fixing process and begins at the start of the exposure process executed based on the start time for supplying the prescribed sheet S and ends when the prescribed sheet S passes the fixing sheet sensor SE2. In the following description, the printing process performed on the first sheet SH1 will be called the "first printing process," and the printing process performed on the second sheet SH2 will be called the "second printing process." When performing continuous printing on a plurality of sheets S, the controller 100 repeatedly executes the first printing process and second printing process.

Prior to executing the first image-forming process and the second image-forming process, the controller 100 executes the preliminary process to activate the image-forming section 30 and the fixing device 80. In the preliminary process, the controller 100 performs an agitating process for rotating the agitators 56 and the like in order to agitate toner in the process cartridges 50, a process for controlling the chargers 52 to charge the corresponding photosensitive drums 51, a process for controlling the heater 110 so that the temperature of the nip area NP reaches a fixing temperature suitable for fixing, and a process for rotating the first fixing member 81 and the like.

The controller 100 always executes the preliminary process after receiving a print command and before beginning to supply the first sheet S. Additionally, when beginning to supply the second and subsequent sheets S, the controller 100 selectively executes the preliminary process according to the progress of the development process and the like. Note that in the preliminary process executed initially after a print command was received, the controller 100 also executes the developing roller contact process and the nip pressure increasing process described later. In the following description, the preliminary process that is executed first after a print command is received will be called the "initial preliminary process."

The nip pressure reducing process is performed to change the pressure at the nip area NP from the maximum nip pressure or the intermediate nip pressure to the minimum nip pressure. Specifically, in the nip pressure reducing process the controller 100 first rotates the developing motor M1 in the reverse direction while the developing clutch C1 is in the first cutoff state, and subsequently switches the pressure-modifying clutch C2 to the second transmission state to pivotally move (or rotate) the cam 340 from the first cam position or the intermediate cam position to the second cam position. Additionally, the controller 100 rotates the developing motor M1 in the reverse direction at a slower rotational speed than the speed used during printing. Note that the controller 100 rotates the developing motor M1 in the forward direction during printing.

The nip pressure increasing process is performed to change the pressure at the nip area NP from the minimum nip pressure to the intermediate nip pressure or the maximum nip pressure. Specifically, in the nip pressure increasing process the controller 100 first rotates the developing motor M1 in the forward direction while the developing clutch C1 is in the first cutoff state, and subsequently changes the pressure-modifying clutch C2 to the second transmission state in order to pivotally move (or rotate) the cam 340 from the second cam position to the intermediate cam position or the first cam position. Additionally, the controller 100 rotates the developing motor M1 in the nip pressure increasing process at a slower rotational speed than the speed used during printing.

In the cleaning process, toner collected on the cleaning rollers 55 is recovered by the belt cleaner 10 via the photosensitive drums 51 and the transfer belt 73. Specifically, in the cleaning process the controller 100 applies a voltage having the same polarity as the toner to the cleaning rollers 55 and applies a voltage of reverse polarity from the toner to the transfer rollers 74 and the sliding contact roller 11. Through this operation, toner carried on the cleaning rollers 55 is first transferred to the corresponding photosensitive drums 51 and subsequently transferred onto the transfer belt 73 to be collected by the belt cleaner 10.

The developing roller separation process is performed to switch the state of the developing rollers 53 from the contact state to the separated state. Specifically, while the developing rollers 53 are in the contact state and the developing motor M1 is rotating in the forward direction, the controller 100 places the developing clutch C1 in the first transmission state to switch the developing rollers 53 to the separated state.

The developing roller contact process is performed to switch the developing rollers 53 from the separated state to the contact state. Specifically, while the developing rollers 53 are in the separated state and the developing motor M1 is rotating in the forward direction, the controller 100 places the developing clutch C1 in the first transmission state to switch the developing rollers 53 from the separated state to the contact state.

The determination process is performed to determine whether the second development process started prior to the end of the first printing process (the first fixing process) has been completed. The controller 100 executes various processes according to the results of the determination process and the timing at which the determination was made.

Specifically, if the controller 100 determines that the second development process was completed within a first prescribed time T1 following completion of the first printing process (the first fixing process), the controller 100 executes the second printing process (the second image-forming process) without executing the nip pressure reducing process. If the controller 100 determines that the second development process was not completed during the first prescribed time T1 following completion of the first printing process (the first fixing process), the controller 100 executes the nip pressure reducing process after the first prescribed time T1 has elapsed, executes the nip pressure increasing process after completion of the second development process, and subsequently executes the second printing process (the second image-forming process).

If the controller 100 determines that the second development process was not completed during a second prescribed time T2 shorter than the first prescribed time T1 after completion of the first printing process, the controller 100 begins a cleaning process after the second prescribed time T2 has elapsed following completion of the first printing process. After starting the cleaning process and when determining that the second development process was not completed during the first prescribed time T1 following completion of the first printing process, the controller 100 executes the nip pressure reducing process in parallel with the cleaning process.

The first prescribed time T1 and the second prescribed time T2 in the present embodiment have a relationship specified in the following equation (refer also to FIG. 10B).

$$T1=T2+Tc-Tn$$

Here, Tc is the time required to complete the cleaning process, and Tn is the time required to perform the nip pressure reducing process.

If the controller 100 determines that the second development process was completed while executing the nip pressure reducing process, the controller 100 immediately executes the nip pressure increasing process after completion of the nip pressure reducing process. If the controller 100 determines that the second development process is completed after initiating the cleaning process and before the first prescribed time T1 has elapsed after completion of the first printing process, the controller 100 begins executing a preliminary process in parallel with the cleaning process to prepare for executing the second image-forming process and does not execute the nip pressure reducing process.

Next, the operations of the controller 100 will be described with reference to FIG. 8. The controller 100 executes the process shown in FIG. 8 upon receiving a print command.

Figure 8:
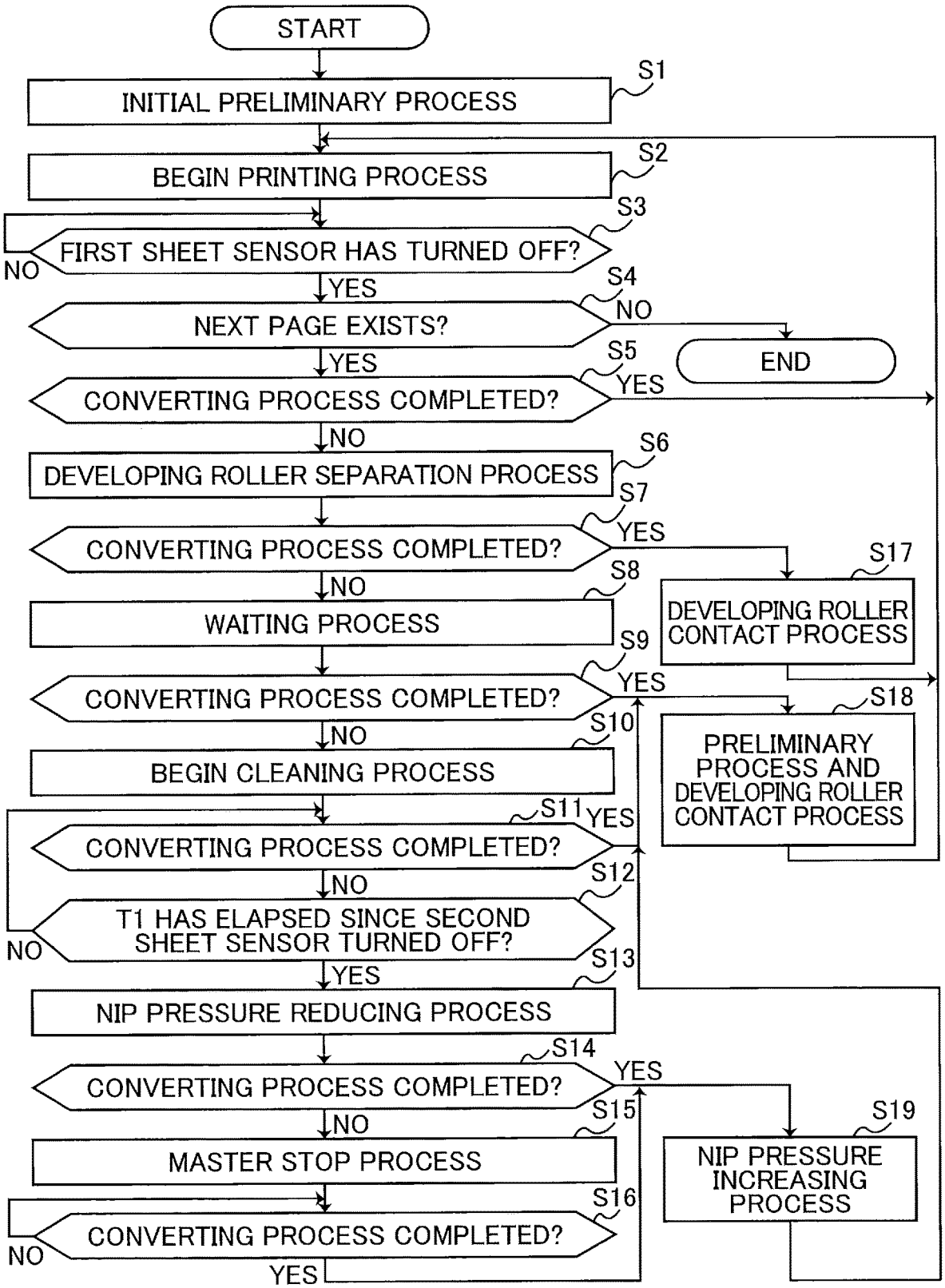
FIG. 8 is a flowchart illustrating steps in a process executed by the controller of the color printer according to the embodiment of the present disclosure.

In S1 of the process in FIG. 8, the controller 100 executes the initial preliminary process. During non-printing times, each developing roller 53 is in the separated state and the nip pressure at the nip area NP is the minimum nip pressure. During the initial preliminary process, the controller 100 switches on the heater 110 and the chargers 52; executes a process for rotating the first fixing member 81, the developing rollers 53, the photosensitive drums 51, the agitators 56, and the like; and executes the developing roller contact process and the nip pressure increasing process.

In S2 the controller 100 begins the printing process for the first sheet S. Specifically, the controller 100 begins feeding the sheet S prior to the printing process and begins the printing process based on the start time for supplying the sheet S. In S3 the controller 100 determines whether the trailing edge of the sheet S has passed the first sheet sensor SE1 by determining whether the first sheet sensor SE1 has switched from ON to OFF. The controller 100 repeats the determination in S3 while the first sheet sensor SE1 remains ON (S3: NO).

Note that the transfer of toner images onto the sheet S is nearly completed when the trailing edge of the sheet S has passed the first sheet sensor SE1. Therefore, the printing process begun in S2 is complete a prescribed time after the trailing edge of the sheet S has passed the first sheet sensor SE1. Further, if a subsequent printing process is not to be performed continuously after completion of the current printing process, the controller 100 turns off the heater 110.

When the controller 100 determines in S3 that the sheet sensor SE1 has switched from ON to OFF (S3: YES), in S4 the controller 100 determines whether a next page exists, and specifically whether image data exists for a page to be printed on the next sheet S. In the following description, the phrase "the first sheet sensor SE1 has switched from ON to OFF" will be simplified to "the first sheet sensor SE1 has turned off" for convenience.

If the controller 100 determines in S4 that a next page does not exist (S4: NO), the controller 100 executes post-processes such as the developing roller separation process and the nip pressure reducing process and subsequently ends the process of FIG. 8. However, if the controller 100 determines that a next page exists (S4: YES), in S5 the controller 100 determines whether the converting process to convert print data for the next page was completed prior to the first sheet sensor SE1 turning off. If the controller 100 determines in S5 that the converting process for the next page was completed (S5: YES), the controller 100 returns to S2 and immediately begins a printing process for the next page after the printing process begun during the previous execution of the process of S2 has been completed (see FIG. 9A).

If the controller 100 determines in S5 that the converting process for the next page has not been completed (S5: NO), in S6 the controller 100 executes the developing roller separation process. In S7 the controller 100 determines whether the converting process for the next page was completed while executing the developing roller separation process.

If the controller 100 determines that the converting process for the next page was completed while executing the developing roller separation process (S7: YES), in S17 the controller 100 begins the developing roller contact process and subsequently returns to S2 to begin the printing process for the next page. That is, the controller 100 begins the printing process on the next page before the developing roller contact process is completed (see FIG. 9B).

Here, the developing roller contact process need only be completed by the time the portions of the photosensitive drums 51 exposed by the LED units 40 have reached positions opposing the corresponding developing rollers 53.

On the other hand, if the controller 100 determines in S7 that the converting process for the next page was not completed while executing the developing roller separation process (S7: NO), in S8 the controller 100 waits for a prescribed wait time. In the present embodiment, the prescribed wait time is set so that the time from completion of the first printing process to completion of the waiting process is equivalent to the second prescribed time T2. The waiting process in S8 is performed to avoid executing the cleaning process prior to executing the printing process for the next page, but the waiting process may be omitted.

In S9 the controller 100 determines whether the converting process for the next page has been completed during the waiting process. If the controller 100 determines that the converting process for the next page has been completed (S9: YES), in S18 the controller 100 executes the preliminary process for the next page and the developing roller contact process. Subsequently, the controller 100 returns to S2 and begins the printing process for the next page. In the preliminary process for the next page, the controller 100 turns on the heater 110 so that the temperature of the nip area NP is raised to the fixing temperature.

If the controller 100 determines in S9 that the converting process for the next page was not completed during the waiting process (S9: NO), in S10 the controller 100 begins the cleaning process. In other words, the cleaning process in S10 is begun when the converting process for the next page was not completed during the second prescribed time T2 following completion of the first printing process. In S1*l* the controller 100 determines whether the converting process for the next page was completed during the cleaning process.

If the controller 100 determines that the converting process for the next page was completed during the cleaning process (S11: YES), the controller 100 executes the process in S18 in parallel with the cleaning process (see FIG. 9C).

However, if the controller 100 determines in S1*l* that the converting process for the next page was not completed during the cleaning process (S11: NO), in S12 the controller 100 determines whether the first prescribed time T1 has elapsed since the first printing process was completed, that is, since the printing process for the previous page was completed, and specifically, since the second sheet sensor SE2 switched from ON to OFF. In other words, steps S10 through S12 are performed to determine whether the converting process for the next page was completed during the cleaning process and before the first prescribed time T1 elapses after completion of the printing process for the previous page.

If the controller 100 determines in S12 that the first prescribed time T1 has not elapsed (S12: NO), the controller 100 returns to the process in S11. However, if the controller 100 determines in S12 that the first prescribed time T1 has elapsed (S12: YES), in S13 the controller 100 executes the nip pressure reducing process in parallel with the cleaning process (see FIG. 10A).

In S14 the controller 100 determines whether the converting process for the next page has been completed during the nip pressure reducing process. If the controller 100 determines that the converting process for the next page has been completed during the nip pressure reducing process (S14: YES), in S19 the controller 100 executes the nip pressure increasing process and subsequently advances to S18 (see FIG. 10A).

However, if the controller 100 determines that the converting process for the next page has not been completed during the nip pressure reducing process (S14: NO), in S15 the controller 100 executes a master stop process to halt driving of the photosensitive drums 51, the developing rollers 53, the first fixing member 81, and other members; to halt the power supply to the heater 110; and to halt the voltage applied to the chargers 52.

In S16 the controller 100 determines whether the converting process for the next page has been completed during the master stop process and repeats the determination while the converting process has not completed (S16: NO). When the controller 100 determines that the converting process for the next page has been completed during the master stop process (S16: YES), the controller 100 advances to S19 (see FIG. 10B).

Next, representative examples for operations of the controller 100 will be described with reference to FIGS. 9A, 9B, 9C, 10A and 10B. FIGS. 9A, 9B, 9C, 10A and 10B illustrate examples various processes executed for the first sheet SH1, which is a sheet S to be initially printed after a print command is received, and the second sheet SH2, which is a sheet S conveyed immediately after the first sheet SH1. The processes performed for the third and subsequent sheets S are substantially the same.

Figure 9A:
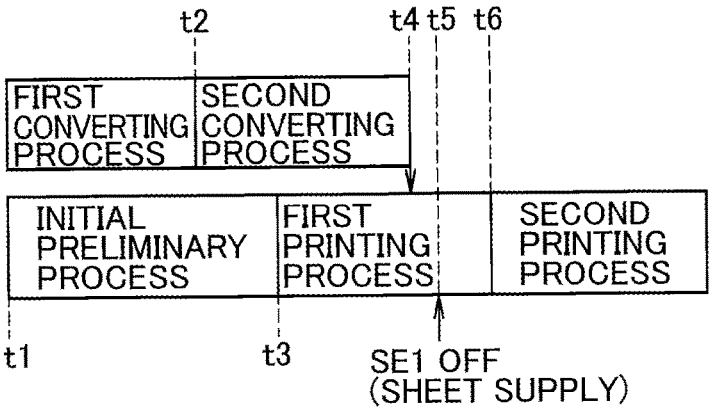
FIG. 9A is a timing chart illustrating timings of processes executed by the controller in accordance with a timing of completion of a second converting process when the second converting process is completed before a first prescribed time has elapsed since a first printing process was completed, where

As shown in FIG. 9A, the controller 100 begins the first converting process and the initial preliminary process upon receiving a print command (timing t1). If the first converting process is completed while executing the initial preliminary process (timing t2), the controller 100 begins the second converting process. After the initial preliminary process is subsequently completed (timing t3), the controller 100 begins the first printing process.

Note that the initial preliminary process may be ended when the temperature of the nip area NP has risen near the fixing temperature. However, the controller 100 continues executing the initial preliminary process if the first converting process has not been completed when the temperature of the nip area NP has risen near the fixing temperature. Therefore, the first printing process is always executed immediately after the initial preliminary process.

If the second converting process is completed (timing t4) prior to a timing t5 in the first printing process at which the first sheet sensor SE1 turns off, the controller 100 executes the second printing process (timing t6) immediately after completion of the first printing process.

Figure 9B:
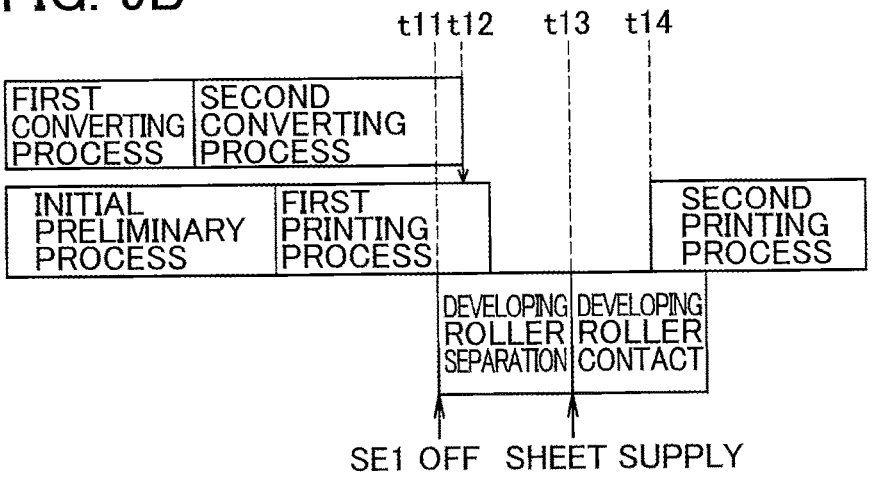
FIG. 9B is a timing chart illustrating timings of processes executed by the controller in accordance with the timing of the completion of the second converting process when the second converting process is completed before the first prescribed time has elapsed since the first printing process was completed, where

In the example shown in FIG. 9B, the controller 100 begins the developing roller separation process (timing t11) if the first sheet sensor SE1 turns off before the second converting process has been completed. If the second converting process is completed during the developing roller separation process (timing t12), the controller 100 begins the developing roller contact process (timing t13) immediately after completion of the developing roller separation process. Subsequently, at a prescribed timing (timing t14) during execution of the developing roller contact process, the controller 100 executes the second printing process.

Figure 9C:
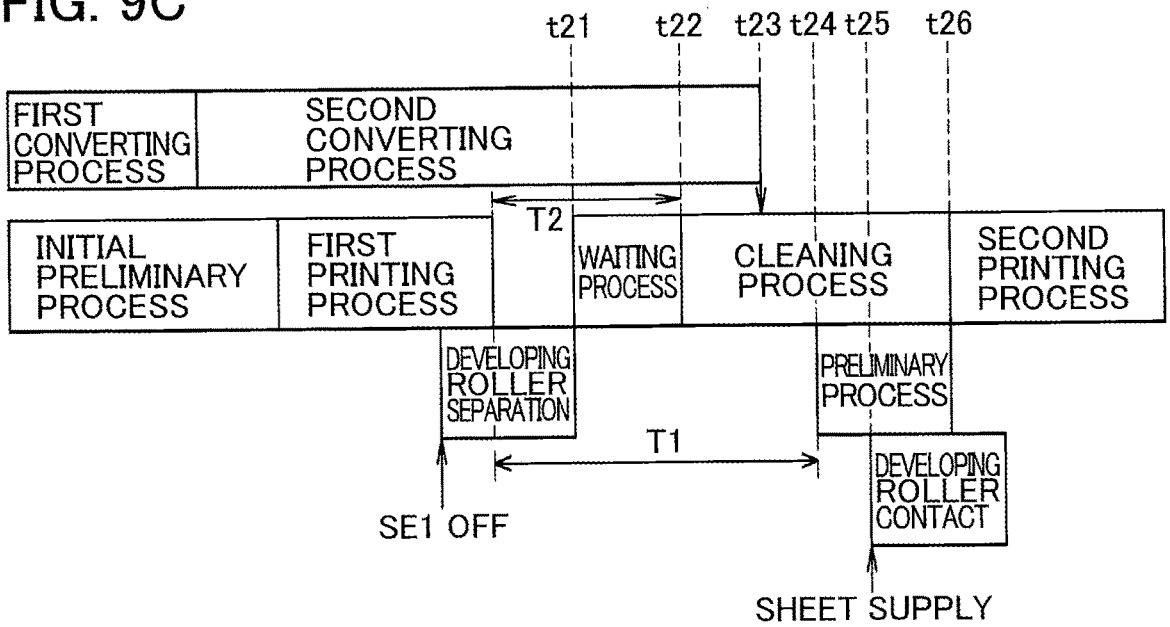
FIG. 9C is a timing chart illustrating timings of processes executed by the controller in accordance with the timing of the completion of the second converting process when the second converting process is completed before the first prescribed time has elapsed since the first printing process was completed, where

In the example shown in FIG. 9C, the controller 100 executes a waiting process (timing t21) immediately after completion of the developing roller separation process when the second converting process was not completed during the developing roller separation process. If the second converting process was not completed during the waiting process, i.e., if the second converting process has not been completed even after the second prescribed time T2 has elapsed following completion of the first printing process, the controller 100 begins the cleaning process (timing t22) immediately after completion of the waiting process.

If the second converting process is completed (timing t23) during the cleaning process and before the first prescribed time T1 has elapsed following completion of the first printing process, the controller 100 begins the preliminary process (timing t24) during the cleaning process. Subsequently, the controller 100 begins the developing roller contact process (timing t25) while executing both the cleaning process and the preliminary process. Next, the controller 100 begins the second printing process (timing t26) after completion of the cleaning process and during execution of the developing roller contact process.

Figure 10A:
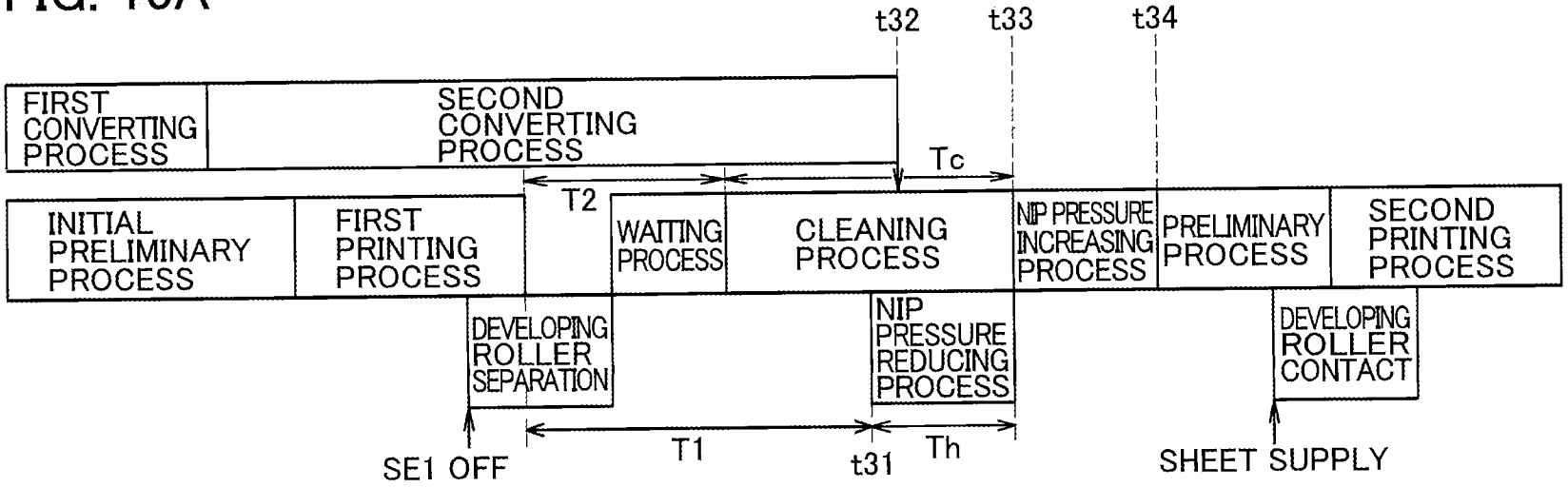
FIG. 10A is a timing chart illustrating timings of processes executed by the controller in accordance with the timing of the completion of the second converting process when the second converting process is completed after the first prescribed time has elapsed since the first printing process was completed, where

As shown in the example of FIG. 10A, if the second converting process has not been completed even after the first prescribed time T1 has elapsed following completion of the first printing process, the controller 100 executes the nip pressure reducing process (timing t31) in parallel with the cleaning process. If the second converting process is completed during the nip pressure reducing process (timing t32), the controller 100 executes the nip pressure increasing process (timing t33) immediately after completion of the nip pressure reducing process and the cleaning process. Note that the nip pressure reducing process and the cleaning process are ended at the same timing (timing t33) since the first prescribed time T1 and the second prescribed time T2 are set to satisfy the equation described above. Once the nip pressure increasing process has ended (timing t34), the controller 100 executes the preliminary process, the developing roller contact process, and the second printing process in succession.

Figure 10B:
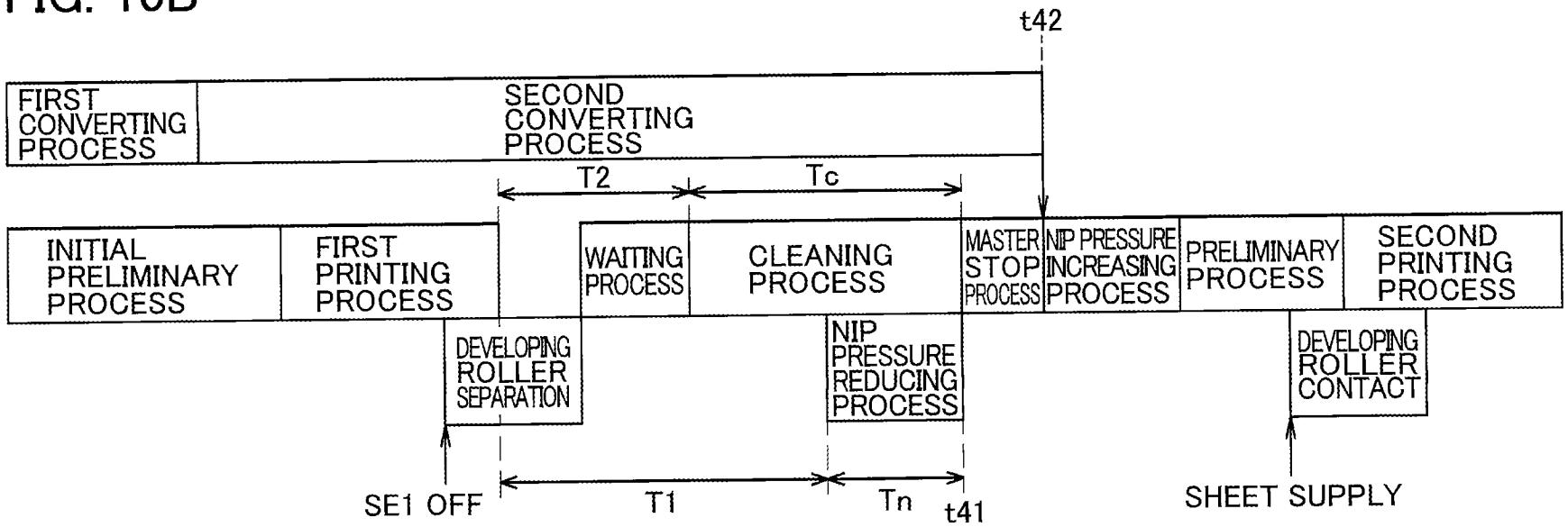
FIG. 10B is a timing chart illustrating timings of processes executed by the controller in accordance with the timing of the completion of the second converting process when the second converting process is completed after the first prescribed time has elapsed since the first printing process was completed, where

In the example shown in FIG. 10B, if the second converting process was not completed during the nip pressure reducing process, the controller 100 executes a master stop process (timing t41) immediately after completion of the nip pressure reducing process and the cleaning process. When the second converting process is completed during execution of the master stop process (timing t42), the controller 100 executes the nip pressure increasing process, the preliminary process, the developing roller contact process, and the second printing process in succession, as in the example of FIG. 10A.

Through the above processes, the following effects can be obtained in the present embodiment.

If the second converting process is completed within the first prescribed time T1 following completion of the first printing process, the controller 100 can start the second printing process at an earlier timing by executing the second printing process without performing the nip pressure reducing process. Accordingly, if the converting process creates a delay during continuous printing, the controller 100 according to the embodiment can prevent the delay from excessively increasing the time required for performing continuous printing from start to finish.

If the second printing process is not started before the first prescribed time T1 following completion of the first fixing process has elapsed, the controller performs the nip pressure reducing process without performing the second printing process. Accordingly, if the sheet tray 21 runs out of sheets and the first sheet sensor SE1 does not detect any sheet S during the first prescribed time T1 following the printing process for the first sheet SH1 is completed, the controller 100 according to the embodiment does not start the printing process for the second sheet SH2 even though the second converting process for the second sheet SH2 has been completed. By executing the nip pressure reducing process simultaneously with the cleaning process, the controller 100 can start the second printing process at an earlier timing than when executing the nip pressure reducing process after the cleaning process, for example.

By setting the first prescribed time T1 and the second prescribed time T2 so that their relationships with the time Tn required for the nip pressure reducing process and the time Tc required for the cleaning process is "T1=T2+Tc−

Tn," the completion timing for the nip pressure reducing process can be made to coincide with the completion timing of the cleaning process. Hence, processes following completion of the cleaning process can be performed more quickly than when the completion timing for the nip pressure reducing process comes later than the completion timing for the cleaning process, for example. Further, since the length of the first prescribed time T1 can be set greater in the present embodiment than when the completion timing of the nip pressure reducing process comes earlier than the completion timing of the cleaning process, for example, the controller 100 of the embodiment can delay the start timing for the nip pressure reducing process.

When the second converting process is completed during execution of the nip pressure reducing process, the controller 100 in the present embodiment immediately executes the nip pressure increasing process following completion of the nip pressure reducing process. Accordingly, the second printing process can be started at an earlier timing in the present embodiment than when executing the nip pressure increasing process with a period of time from completion of the nip pressure reducing process, for example.

If the second converting process is completed after starting the cleaning process and prior to the first prescribed time T1 elapsing after completion of the first printing process, the controller 100 of the present embodiment executes the preliminary process in parallel with the cleaning process. Accordingly, the second printing process can be started at an earlier timing than when executing the preliminary process following the cleaning process, for example.

Since the drive force of the developing motor M1 is used both for switching the developing rollers 53 between the contact states and the separated states and for modifying the nip pressure, the embodiment can reduce costs.

When modifying the nip pressure, the rotational speed of the developing motor M1 is set to a slower speed than the rotational speed used during printing, thereby reducing noise that can occur when driving the cam 340.

The second nip pressure is set to the smallest nip pressure in the modifying range of the pressure-modifying mechanism 300, thereby suppressing wear caused by sliding friction between the belt 130, which rotates by following the first fixing member 81 rotating, and the nip-forming member N that supports the belt 130 from the side opposite the first fixing member 81.

While the description has been made in detail with reference to a specific embodiment, it would be apparent to those skilled in the art that many modifications and variations may be made thereto.

While the cleaning rollers 55 are used as an example of the cleaning member in the present embodiment, the cleaning member may be plate-like blades, for example.

The image-forming section of the present disclosure is not limited to the image-forming section 30 described in the present embodiment. For example, the image-forming section may be provided with an exposure device that emits laser beams.

In the embodiment, the pressure-modifying mechanism 300 is configured to modify the nip pressure of the nip area NP among the maximum nip pressure, the intermediate nip pressure, and the minimum nip pressure. However, the pressure-modifying mechanism should be capable of modifying the nip pressure at the nip area between at least the first nip pressure and the second nip pressure. Thus, the pressure-modifying mechanism may be configured to modify the nip pressure among two or four or more pressure values.

The pressure-modifying mechanism is not limited to the construction described in the embodiment. For example, the pressure-modifying mechanism may be configured of a structure similar to that shown in FIG. 5A but excluding the cam follower 350 and the second spring 330, for example. In other words, the cam 340 may be configured to contact the arm body 311.

Although the present disclosure is applied to the color printer 1 in the embodiment, the present disclosure may instead be applied to another image-forming device, such as a monochrome printer, a copying machine, or a multifunction peripheral.

While a halogen lamp is used as an example of the heater in the embodiment, the heater may be a carbon heater or the like.

While the first fixing member in the present embodiment is described as a cylindrical roller with a built-in heater 110, the first fixing member of the present disclosure may be an endless belt having a heater for heating the inner surface of the belt. Alternatively, the heater may be disposed outside the first fixing member and may employ an external heating system or an induction heating system to heat the outer surface of the first fixing member. Further, a heater may be provided in the second fixing member and may heat the first fixing member indirectly as the first fixing member contacts the outer surface of the second fixing member. Alternatively, both the first fixing member and the second fixing member may be provided with built-in heaters. The second fixing member may also be a pressure roller or the like having a shaft, and a rubber layer formed around the shaft.

The technical elements described above in the embodiment and its variations may be used in any suitable combination.

What is claimed is:

1. An image-forming apparatus comprising:

an image-forming section configured to form a developer image on a sheet;

a fixing device configured to fix the developer image on the sheet, the fixing device comprising:

a first fixing member having a roller configured to rotate about a rotational axis;

a second fixing member having a belt configured to form a nip together with the first fixing member, the belt being configured to rotate around a rotation center; and a pressure modifying mechanism configured to modify a nip pressure at the nip to one of a first nip pressure and a second nip pressure smaller than the first nip pressure; and a controller configured to perform:

a converting process to convert print data corresponding to a print job for a plurality of sheets, the plurality of sheets including a first sheet and a second sheet to be conveyed to the image-forming section following the first sheet, the converting process comprising:

a first converting process to convert the print data into first raster image data for the first sheet; and a second converting process to convert the print data into second raster image data for the second sheet;

a first image-forming process to form a first developer image on the first sheet using the first raster image data with the image-forming section;

a first fixing process to fix the first developer image to the first sheet with the fixing device at the first nip pressure;

a second image-forming process to form a second developer image on the second sheet using the second raster image data with the image-forming section;

a second fixing process to fix the second developer image to the second sheet with the fixing device at the first nip pressure; and a determining process to determine whether the second converting process is completed before elapse of a first prescribed time, the first prescribed time being a time period following completion of the first fixing process, wherein in response to determining in the determining process that the second converting process is not completed before the elapse of the first prescribed time, the controller further performs a nip pressure reducing process to modify the nip pressure from the first nip pressure to the second nip pressure, and wherein in response to determining in the determining process that the second converting process is completed before the elapse of the first prescribed time, the controller performs the second fixing process without performing the nip pressure reducing process.

2. The image-forming apparatus according to claim 1, wherein when the second converting process is completed after the nip pressure reducing process is performed, the controller performs a nip pressure increasing process to modify the nip pressure from the second nip pressure to the first nip pressure after completion of the nip pressure reducing process.

3. The image-forming apparatus according to claim 1, further comprising:

a photosensitive member;

a cleaning member configured to collect developer deposited on the photosensitive member;

a transfer belt that is an endless belt contacting the photosensitive member; and a belt cleaner configured to recover developer deposited on the transfer belt, wherein when the second converting process is not completed during a second prescribed time shorter than the first prescribed time following the completion of the first fixing process, the controller further performs a cleaning process to recover developer collected on the cleaning member by the belt cleaner via the photosensitive member and the transfer belt after the second prescribed time has elapsed following the completion of the first fixing process.

4. The image-forming apparatus according to claim 3, wherein assuming that the first prescribed time is T1, the second prescribed time is T2, a time required to complete the cleaning process is Tc, and a time required to complete the nip pressure reducing process is Tn, a relation $T1=T2+Tc-Tn$ is satisfied.

5. The image-forming apparatus according to claim 3, wherein the image-forming section comprises an agitator configured to agitate developer, and wherein when the second converting process is completed after starting the cleaning process and before the first prescribed time has elapsed after completion of the first fixing process, the controller further performs an agitating process to rotate the agitator prior to performing the second image-forming process without performing the nip pressure reducing process.

6. The image-forming apparatus according to claim 1, further comprising:

a photosensitive member;

a developing roller configured to supply developer to the photosensitive member;

a switch mechanism configured to switch a state of the developing roller between a contact state in which the developing roller is in contact with the photosensitive member and a separated state in which the developing roller is separated from the photosensitive member, wherein when the second converting process is not completed at a prescribed timing while the first image-forming process is being performed, the controller further performs a developing roller separation process to switch the state of the developing roller from the contact state to the separated state, and wherein the nip pressure reducing process is performed after completion of the developing roller separation process.

7. The image-forming apparatus according to claim 6, further comprising:

a motor configured to drive the switch mechanism and the pressure modifying mechanism;

a developing clutch changeable between a first transmission state in which driving force of the motor is transmitted to the switch mechanism and a first cutoff state in which the driving force of the motor is not transmitted to the switch mechanism; and a pressure modifying clutch changeable between a second transmission state in which the driving force of the motor is transmitted to the pressure modifying mechanism and a second cutoff state in which the driving force of the motor is not transmitted to the pressure modifying mechanism.

8. The image-forming apparatus according to claim 7, wherein the motor is configured to drive the developing roller, wherein the pressure modifying mechanism comprises a cam configured to pivotally move between a first position in which the nip pressure is the first nip pressure and a second position in which the nip pressure is the second nip pressure, the motor being configured to rotate in a forward direction and a reverse direction, the cam being configured to pivotally move from the second position to the first position while the motor rotates in the forward direction, the cam being configured to pivotally move from the first position to the second position while the motor rotates in the reverse direction, wherein the controller is configured to rotate the motor in the forward direction while performing the first image-forming process and the second image-forming process to drive the developing roller, and wherein when performing the nip pressure reducing process, the controller pivotally moves the cam from the first position to the second position by rotating the motor in the reverse direction under a condition that the developing clutch is in the first cutoff state and subsequently placing the pressure modifying clutch in the second transmission state.

9. The image-forming apparatus according to claim 6, further comprising:

a sheet sensor configured to detect a sheet, the sheet sensor being disposed upstream of the image-forming section in a conveying direction of the sheet, wherein the prescribed timing is a timing at which the sheet sensor detects a trailing edge of the first sheet.

10. The image-forming apparatus according to claim 1, wherein the second fixing member comprises:

an upstream pad configured to pinch the belt together with the first fixing member; and a downstream pad disposed downstream of the upstream pad in a conveying direction of the sheet and configured to pinch the belt together with the first fixing member, wherein when the nip pressure is the first nip pressure, both the upstream pad and the downstream pad pinch the belt together with the first fixing member, and wherein when the nip pressure is the second nip pressure, the upstream pad pinches the belt together with the first fixing member whereas the downstream pad does not pinch the belt together with the first fixing member.

11. The image-forming apparatus according to claim 1, wherein the pressure modifying mechanism is configured to modify the nip pressure within a range from a maximum nip pressure to a minimum nip pressure, the second nip pressure being equivalent to the minimum nip pressure.

12. The image-forming apparatus according to claim 1, further comprising a heater configured to heat the roller of the first fixing member.

13. The image-forming apparatus according to claim 1, wherein the second fixing member is configured to move between a nip position in which the nip is formed between the first fixing member and the second fixing member and a nip reducing position in which the rotation center of the belt of the second fixing member is farther away from the rotational axis of the roller than in the nip position.

14. An image-forming apparatus comprising:

an image-forming section configured to form a developer image on a sheet;

a fixing device configured to fix the developer image on the sheet, the fixing device comprising:

a first fixing member having a roller configured to rotate about a rotational axis;

a second fixing member having a belt to form a nip together with the first fixing member, the belt being configured to rotate around a rotation center; and a pressure modifying mechanism configured to modify a nip pressure at the nip to one of a first nip pressure and a second nip pressure smaller than the first nip pressure; and a controller configured to perform:

a converting process to convert print data corresponding to a print job for a plurality of sheets, the plurality of sheets including a first sheet and a second sheet to be conveyed to the image-forming section following the first sheet, the converting process comprising:

a first converting process to convert the print data into first raster image data for the first sheet; and a second converting process to convert the print data into second raster image data for the second sheet;

a first image-forming process to form a first developer image on the first sheet using the first raster image data with the image-forming section;

a first fixing process to fix the first developer image to the first sheet with the fixing device at the first nip pressure;

a second image-forming process to form a second developer image on the second sheet using the second raster image data with the image-forming section;

a second fixing process to fix the second developer image to the second sheet with the fixing device at the first nip pressure; and a determining process to determine whether the second image-forming process is started before elapse of a prescribed time, the prescribed time being a time period following completion of the first fixing process, wherein in response to determining in the determining process that the second image-forming process is not started before the elapse of the prescribed time, the controller further performs a nip pressure reducing process to modify the nip pressure from the first nip pressure to the second nip pressure, and wherein in response to determining in the determining process that the second image-forming process is started before the elapse of the prescribed time, the controller performs the second fixing process without performing the nip pressure reducing process.

15. The image-forming apparatus according to claim 14, further comprising:

a sheet sensor configured to detect a sheet, the sheet sensor disposed upstream of the image-forming section in a conveying direction of the sheet, wherein when the sheet sensor does not detect the second sheet before the prescribed time has elapsed, the controller does not start the second image-forming process.

* * * * *